US006026546A

United States Patent [19]

Lund et al.

[11] Patent Number: 6,026,546

[45] Date of Patent: Feb. 22, 2000

[54] FIGURINES ATTACHED TO A ZIPPER

[75] Inventors: Bruce Donald Lund; Peter Lawrence Visconti, both of Chicago, Ill.

[73] Assignee: Lund & Company, Chicago, Ill.

[21] Appl. No.: 08/827,266

[22] Filed: Mar. 28, 1997

[51] Int. Cl.[7] ..... A44B 19/26

[52] U.S. Cl. ..... 24/431; 24/415; 24/426; 24/429

[58] Field of Search ..... 24/421, 426, 429, 24/400, 431, 415

[56] References Cited

U.S. PATENT DOCUMENTS

| | | | |
|---|---|---|---|
| D. 194,103 | 11/1962 | Weston et al. . | |
| D. 273,757 | 5/1984 | Evans . | |
| D. 311,158 | 10/1990 | Soule . | |
| D. 319,804 | 9/1991 | Johnson et al. . | |
| D. 320,955 | 10/1991 | Horita et al. . | |
| D. 321,333 | 11/1991 | Soule . | |
| D. 354,699 | 1/1995 | Madeleine . | |
| D. 372,440 | 8/1996 | Gelb . | |
| 1,497,802 | 6/1924 | Sneed . | |
| 2,023,516 | 12/1935 | Cowen . | |
| 2,145,118 | 1/1939 | Knoess . | |
| 2,148,757 | 2/1939 | Kilkenny . | |
| 2,177,344 | 10/1939 | Lange . | |
| 2,181,625 | 11/1939 | Mucci et al. | 24/424 X |
| 2,232,756 | 2/1941 | Marcus . | |
| 2,277,831 | 3/1942 | Poux . | |
| 2,292,484 | 8/1942 | Schwartz . | |
| 2,497,740 | 2/1950 | Poux . | |
| 2,570,378 | 10/1951 | Rinehart | 24/431 |
| 2,933,792 | 4/1960 | Malmborg | 24/426 |
| 3,028,647 | 4/1962 | Greenberg . | |
| 3,831,316 | 8/1974 | Weistrop . | |
| 3,919,745 | 11/1975 | Dupon | 24/424 |
| 4,368,562 | 1/1983 | Minami . | |
| 4,704,770 | 11/1987 | Minami et al. . | |
| 4,710,979 | 12/1987 | Bull et al. . | |
| 4,768,263 | 9/1988 | Fukuroi et al. | 24/421 X |
| 4,835,794 | 6/1989 | Chen et al. . | |
| 4,873,750 | 10/1989 | Tracy . | |
| 4,949,434 | 8/1990 | Minami | 24/429 |
| 4,954,117 | 9/1990 | Daleus . | |
| 4,974,432 | 12/1990 | Blake | 70/68 |
| 5,007,145 | 4/1991 | Kim . | |
| 5,081,747 | 1/1992 | Tkizawa et al. . | |
| 5,131,120 | 7/1992 | Akashi . | |
| 5,535,491 | 7/1996 | Allport | 24/429 |
| 5,722,128 | 3/1998 | Toney et al. | 24/400 |

FOREIGN PATENT DOCUMENTS

| | | | |
|---|---|---|---|
| 522593 | 11/1955 | Belgium | 24/429 |
| 991377 | 10/1951 | France | 24/429 |
| 499253 | 1/1939 | United Kingdom | 24/431 |

*Primary Examiner*—James R. Brittain
*Attorney, Agent, or Firm*—Brinks Hofer Gilson & Lione

[57] ABSTRACT

A method of moving a figurine by attaching the figurine to a zipper that is attached to a piece of material and translationally moving the zipper along a first direction and converting the translational movement of the zipper into a separate type of movement which causes the figurine to move.

93 Claims, 21 Drawing Sheets

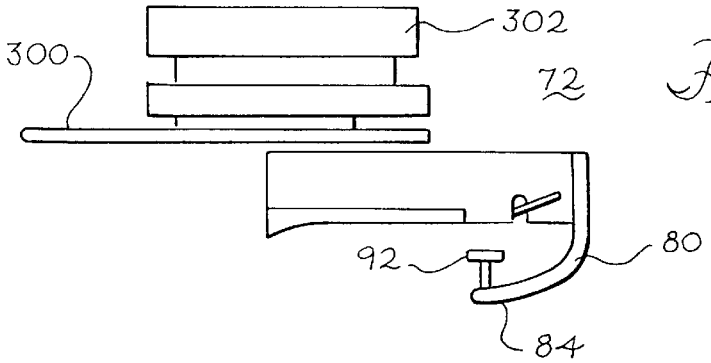
Fig. 4A
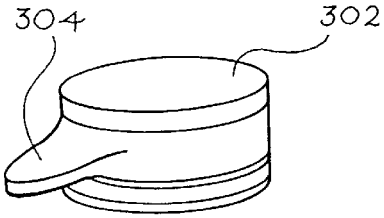
Fig. 4B
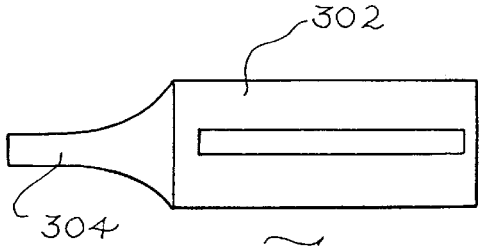
Fig. 4C
Fig. 4D
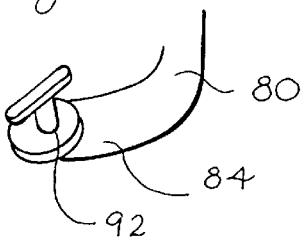
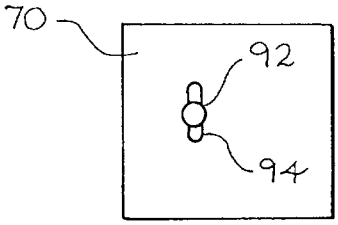
Fig. 4E
Fig. 4G
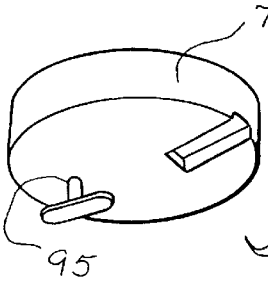
Fig. 4F
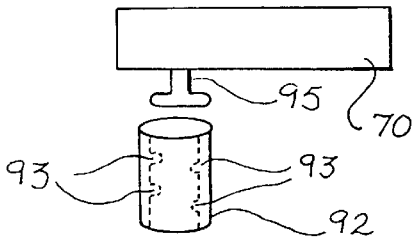

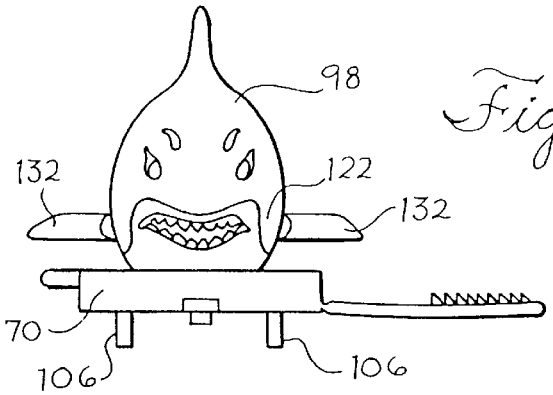
Fig. 9H
Fig. 10A
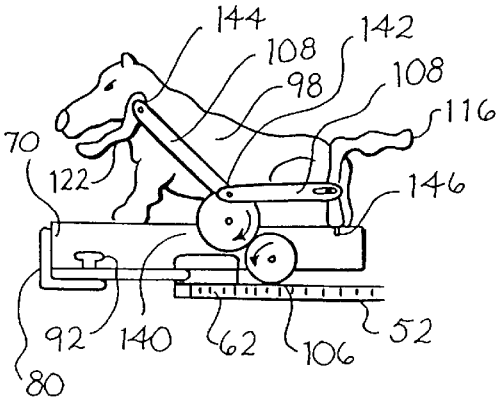
Fig. 10B
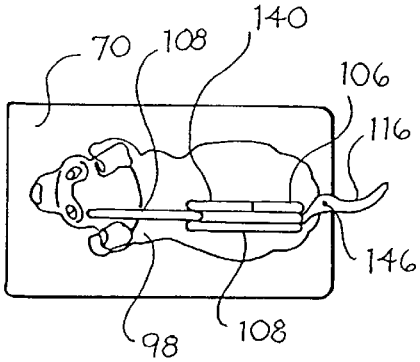
Fig. 11
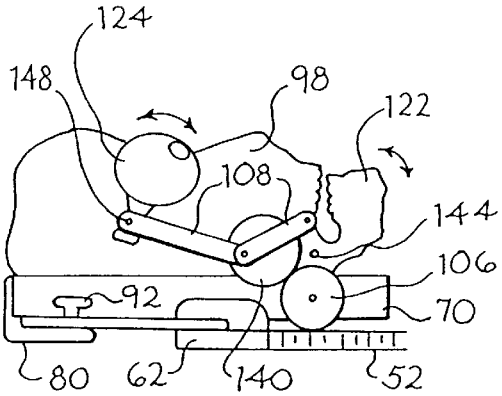
Fig. 12
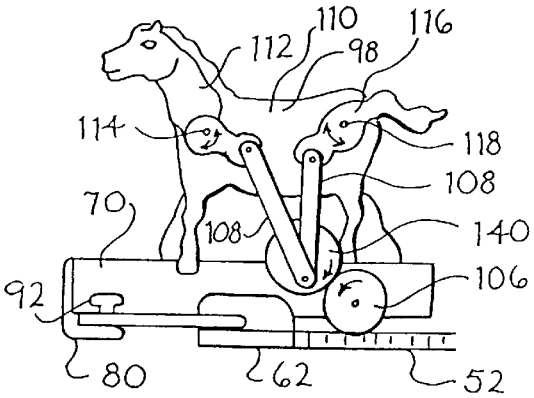

Fig. 18A
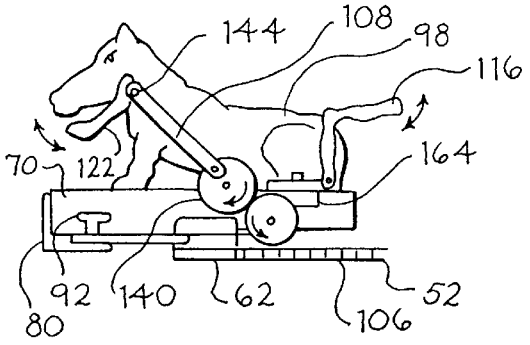
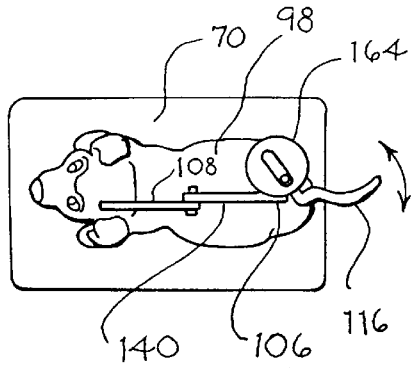
Fig. 18B
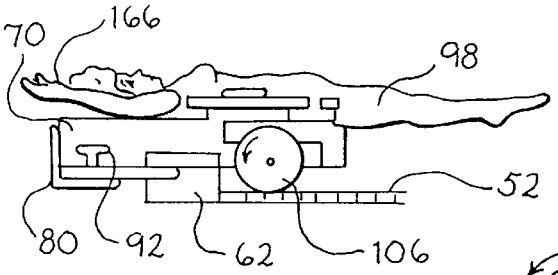
Fig. 19A
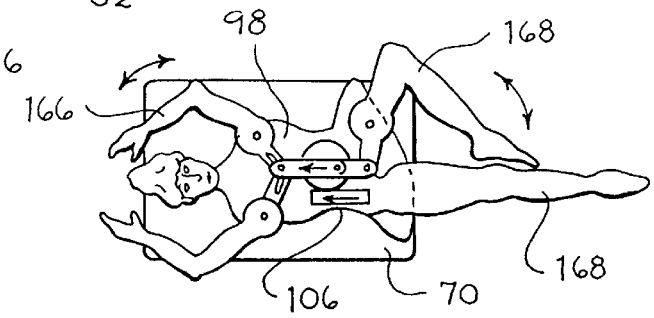
Fig. 19B
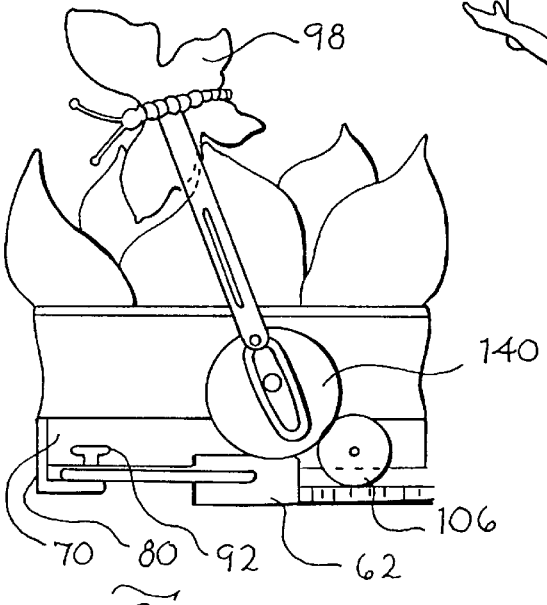
Fig. 20
Fig. 21
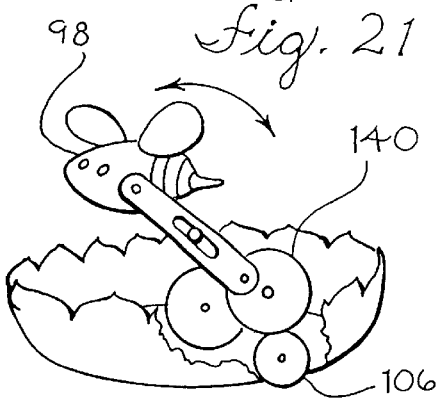

FIGURINES ATTACHED TO A ZIPPER

BACKGROUND OF THE INVENTION

1. Field of the Invention

This invention relates to a system for mounting two dimensional and three dimensional movable figurines onto a zipper.

2. Discussion of Related Art

In the past, ornaments have been attached to zippers. For example, U.S. Pat. No. 2,232,756 to Marcus and U.S. Pat. No. 2,292,484 to Schwartz each disclose various mechanical systems for attaching ornaments, such as a turtle or a hand, to a zipper.

Such devices required complicated and intricate mechanical system for attaching the ornaments to the zipper. Accordingly, the mechanical systems could be costly to employ.

Another disadvantage of past zipper attachment systems is that they were directed to adults since they provide little entertainment value for a youngster operating a zipper.

SUMMARY OF THE INVENTION

A first embodiment of the present invention concerns a figurine and zipper system that includes a zipper attached to a piece of material where the zipper translationally moves along a first direction. A mounting piece is attached to the zipper, wherein the mounting piece translationally moves with the zipper along the first direction. The mounting piece has a coupling mechanism that generates a first type of motion in response to but separate to the translational movement of the zipper along the first direction. The system includes a figurine attached to the coupling mechanism so that the generated first type of motion causes a portion of the figurine to move.

A second aspect of the first embodiment of the present invention involves a figurine and zipper system that has a zipper attached to a piece of material where the zipper translationally moves along a first direction. A mounting piece is attached to the zipper, wherein the mounting piece has both a movable figurine and a coupling mechanism that causes a portion of the figurine to move in response to the translational movement of the zipper along the first direction.

A third aspect of the first embodiment of the present invention involves a method of moving a figurine by attaching the figurine to a zipper that is attached to a piece of material and translationally moving the zipper along a first direction which causes the figurine to move in a manner separate from the translational movement of the zipper.

A fourth aspect of the first embodiment of the present invention regards a method of moving a figurine by attaching the figurine to a zipper that is attached to a piece of material and translationally moving the zipper along a first direction and converting the translational movement of the zipper into a separate type of movement which causes the figurine to move.

A second embodiment of the present invention regards a sound generating zipper system that a zipper attached to a piece of material and which translationally moves along a first direction. A sound element is attached to the zipper, wherein the sound element generates an audible sound in response to the translational movement of the zipper along the first direction.

A second aspect of the second embodiment of the present invention regards a method of generating an audible sound by translationally moving a zipper along a first direction and generating an audible sound in response to the translational movement of the zipper along the first direction which is independent of any sound generated by the zipper itself.

A third embodiment of the present invention regards a zipper attachment system having a fastener with a first row of teeth, a second row of teeth that is adjacent to the first row of teeth and a sliding piece that receives the first and second rows of teeth and interlocks the first and second rows of teeth. A mounting piece is attached to the fastener, wherein the mounting piece comprises a driving wheel.

A second aspect of the third embodiment of the present invention regards a zipper attachment system having a fastener with a first row of teeth, a second row of teeth that is adjacent to said first row of teeth and a sliding piece that receives the first and second rows of teeth and interlocks the first and second rows of teeth. The system further includes a mounting piece attached to a first end of a strap, said mounting attached to the sliding piece by placing the strap over the sliding piece and a second end of the strap is attached to the mounting so that the sliding piece is held in place between the strap and mounting piece.

A third aspect of the third embodiment of the present invention regards a zipper attachment system having a fastener with a first row of teeth, a second row of teeth that is adjacent to the first row of teeth and a sliding piece that receives the first and second rows of teeth and interlocks the first and second rows of teeth. The sliding piece has a handle with an opening so that a mounting piece is attached to the sliding piece by inserting a fastener through the opening and attaching itself to the mounting piece.

A fourth embodiment of the present invention regards a dispenser and zipper system that includes a zipper and a dispenser attached to the zipper, wherein the dispenser has a container that holds an item and access to the item is obtained via an opening formed in the dispenser.

A second aspect of the fourth embodiment regards a method of using a dispenser that has a container that holds an item. The method includes attaching the dispenser to a zipper; removing the item from the dispenser.

A fifth embodiment of the present invention regards a figurine and zipper system having a zipper and a mounting piece attached to the zipper, wherein the mounting piece comprises a structure so that a figurine is removably attached thereto.

A sixth embodiment of the present invention regards a zipper attachment system having a first row of teeth, a second row of teeth that is adjacent to the first row of teeth; and a sliding piece that receives the first and second rows of teeth and interlocks the first and second rows of teeth. A funnel is attached to the sliding piece, wherein the funnel defines an opening into which the first row of teeth is inserted.

Each of the above-mentioned inventions are advantageous in that they are relatively easy to manufacture. Furthermore, the above-mentioned figurine zipper systems, sound generating zipper systems and the dispenser and zipper systems can provide entertainment for youngsters in their moments of idleness.

The foregoing features and advantages of the present invention will be further understood upon consideration of the following detailed description of the invention taken in conjunction with the accompanying drawings, in which:

BRIEF DESCRIPTION OF THE DRAWINGS

FIG. 4A schematically shows a third embodiment of a zipper attachment system to be used with the figurine and zipper system of FIGS. 1A–B;

FIG. 4B schematically shows a perspective view of a rotatable handle to be used with the zipper attachment system of FIG. 4A;

FIG. 4C schematically shows a side view of the rotatable handle of FIG. 4B;

FIG. 4D schematically shows a perspective view of a protrusion to be used with the zipper attachment system of FIG. 4A;

FIG. 4E schematically shows a bottom view of the zipper attachment system of FIGS. 4A–D;

FIG. 4F schematically shows a bottom perspective view of a second embodiment of the zipper attachment system of FIG. 4A;

FIG. 4G schematically shows a side view of the embodiment of the zipper attachment system of FIG. 4F;

FIG. 9H shows a front view of the figurine and zipper system of FIG. 9A;

FIG. 10A schematically shows a side cross-sectional view of an embodiment of a figurine and zipper system where the figurine is a dog;

FIG. 10B shows a top view of the figurine and zipper system of FIG. 10A;

FIG. 11 schematically shows a side cross-sectional view of an embodiment of a figurine and zipper system where the figurine is a skull;

FIG. 12 schematically shows a side cross-sectional view of an embodiment of a figurine and zipper system where the figurine is a horse;

FIG. 18A schematically shows a side cross-sectional view of an embodiment of a figurine and zipper system where the figurine is a dog;

FIG. 18B shows a top view of the figurine and zipper system of FIG. 10A;

FIG. 19A schematically shows a side cross-sectional view of an embodiment of a figurine and zipper system where the figurine is a human dancer;

FIG. 19B shows a top view of the figurine and zipper system of FIG. 10A;

FIG. 20 schematically shows a side cross-sectional view of an embodiment of a figurine and zipper system where the figurine is a butterfly;

FIG. 21 schematically shows a side cross-sectional view of an embodiment of a figurine and zipper system where the figurine is a bee;

DESCRIPTION OF THE PREFERRED EMBODIMENT

Figure 1A:
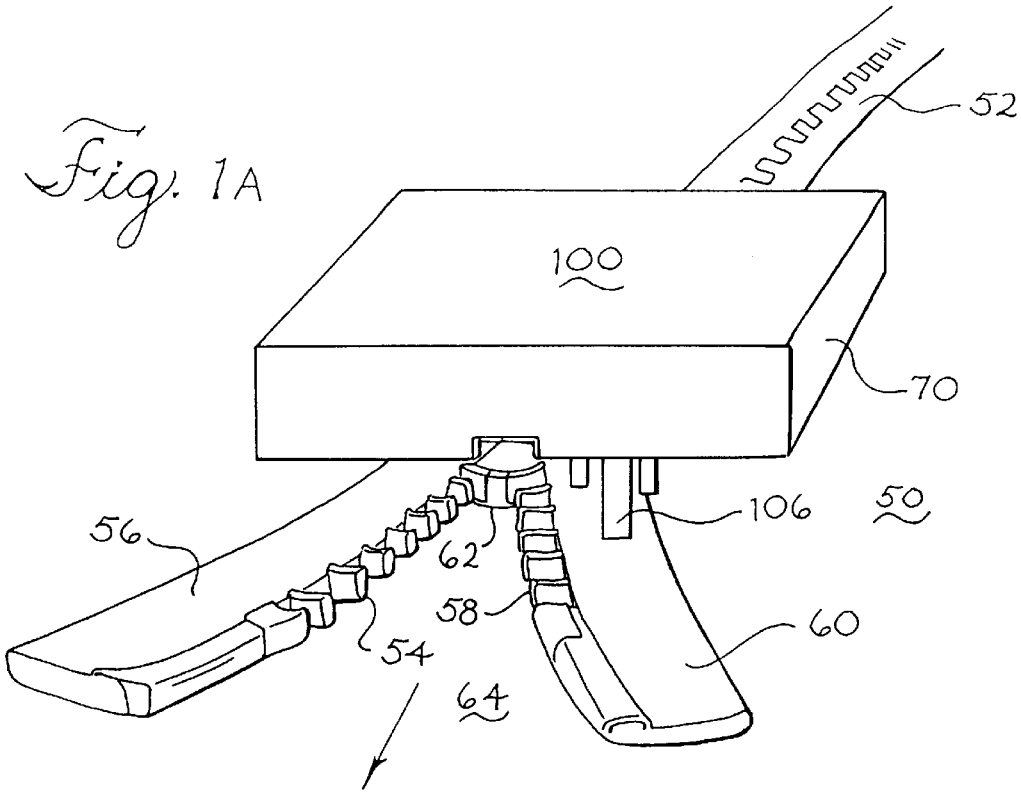
FIGS. 1A–B schematically shows an embodiment of a figurine and zipper system where the figurine is a horse.
Figure 1B:
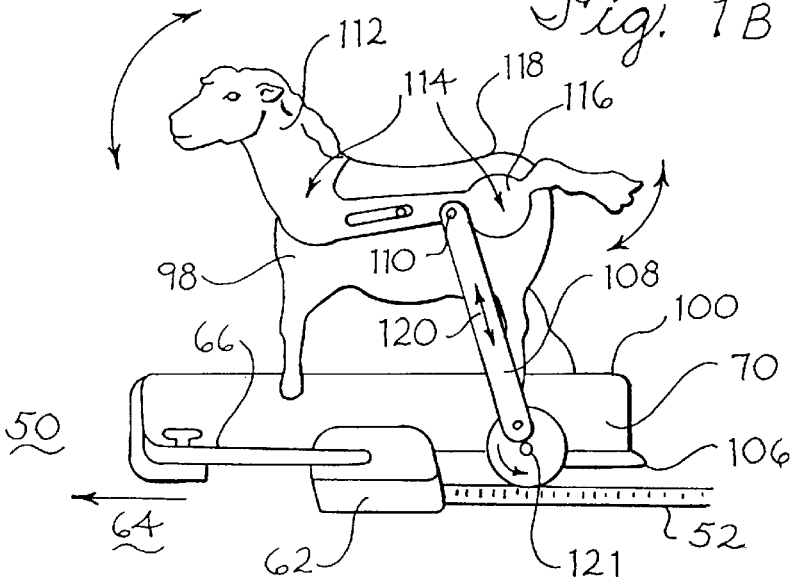

Referring now to the drawings wherein like reference characters designate identical or corresponding parts throughout the several figures, and in particular FIGS. 1A–B schematically shows a figurine and zipper system 50 that includes a movable fastener such as zipper 52. The zipper 52 is well known in structure having a first row of teeth 54 attached to a piece of material 56 and a second row of teeth 58 that is attached to a second piece of material 60 and is adjacent to the first row of teeth 54. The zipper 52 further includes a sliding piece 62 that receives the first and second rows of teeth 54 and 58, respectively, and interlocks the first and second rows of teeth 54 and 58 in a well known manner. The two pieces of material 56 and 60 are attached by translationally moving the sliding piece 62 of the zipper 52 along a direction 64 as shown in FIGS. 1A–B. Movement of the sliding piece 62 is facilitated by pulling on a handle or tab 66 with an opening 68 along the direction 64. The handle 66 is attached to the sliding piece 62 in a well known manner.

Figure 2A:
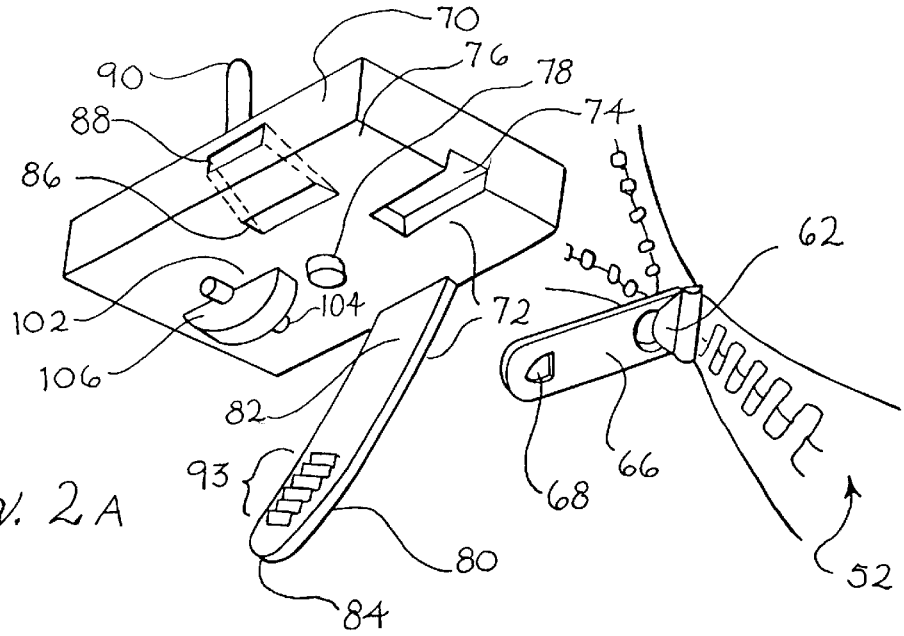
FIG. 2A schematically shows an embodiment of a zipper attachment system to be used with the figurine and zipper system of FIGS. 1A–B.
Figure 2B:
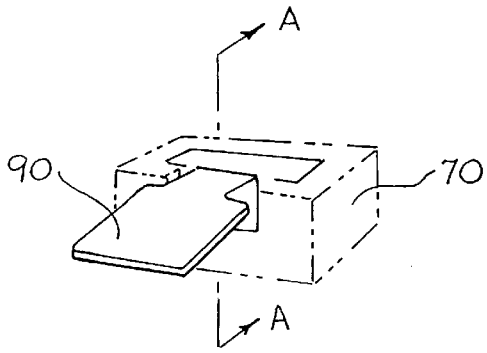
FIG. 2B shows a side view of the zipper attachment system of FIG. 2A.
Figure 2C:
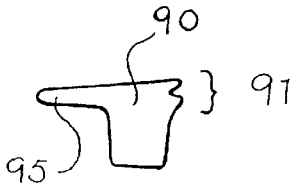
FIG. 2C shows a cross-sectional view taken along line A—A of FIG. 2B.

A mounting piece 70 is attached to the zipper 52 so that the mounting piece 70 translationally moves with the zipper 52 along the direction 64. The mounting piece 70 may have a variety of shapes without departing from the spirit of the invention, such as being rectangular or circular in shape. The mounting piece 70 also may be attached to the zipper 52 in a number of ways. For example, a zipper attachment system 72 may include a slot 74 that is sized to snugly receive the sliding piece 62 as shown in FIGS. 2A–C. When the sliding piece 62 is inserted within the slot 74, the handle 66 is positioned so that it lies flat on the exterior surface 76 of the mounting piece. The mounting piece 70 has a peg 78 which is attached thereto. The peg 78 is inserted through the opening 68 in order to prevent the handle 66 from significantly moving along the exterior surface. The handle 66 is further constrained by a strap 80 that is integrally attached at one end 82 thereof to the mounting piece 70. As shown in FIGS. 2A–C, the strap 80 is placed over the sliding piece 62 and a free end 84 of the strap 80 is inserted through an entry hole 86 formed in the mounting piece 70 and out of an exit opening 88 of the mounting piece 70. The strap 80 is held in place between the openings 86 and 88 by catch release 90. As shown in FIGS. 2B–C, the catch release 90 is integrally attached to the mounting piece 70 and has a ridged engaging portion 91 that engages the grooves 93 of the strap 80. The strap 80 is released from the catch release 90 by pulling on the tab 95 which results in the engaging portion 91 to flex away from the grooves 93. Thus, the sliding piece 62 and the handle 66 are held in place between the strap 80 and the mounting piece 70.

Figure 3:
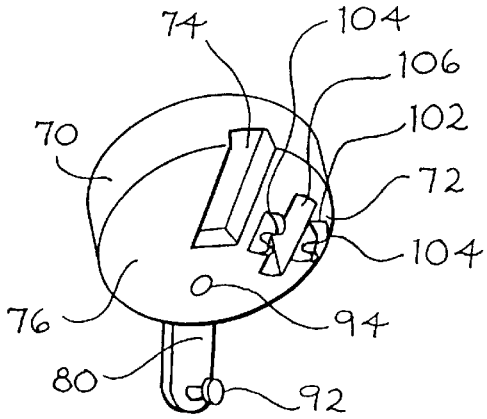
FIG. 3 schematically shows a second embodiment of a zipper attachment system to be used with the figurine and zipper system of FIGS. 1A–B.

Two other possible embodiments for the zipper attachment system 72 is shown in FIGS. 3 and 4. In both embodiments, the strap 80 is attached to the cylindrical mounting piece 70 at the end opposite to where the slot 74 is formed. The free end 84 of the strap 80 lies along the longitudinal axis of the slot 74 and has a protrusion 92. As shown in FIG. 3, once the handle 66 is placed on the exterior surface 76 of the mounting piece 70, the protrusion 92 is inserted through the opening 68 and into the circular hole 94 that is formed in the mounting piece 70 so as to be aligned with the opening 68. As shown in FIGS. 4A, 4D and 4E, the protrusion 92 may be T-shaped and rotatable so that it can enter an oval shaped hole 94. Rotation of the protrusion by 90 degrees prevents the protrusion from being removed. Another attachment variation is shown in FIGS. 4F and 4G where the protrusion 92 is cylindrical in shape and has ridges on threads 93 which engage complementary ridges on threads on a post 95 attached to the mounting piece 70. Note that protrusions 92 of FIGS. 4A and 4D–G may be used with the mounting pieces 70 of FIGS. 1–3 and 4A–B. Note that the mounting piece 70 of FIGS. 4A–B includes two parts—a stationary platform 300 and a rotatable handle 302 with a tab 304. The stationary platform 300 has a circular ring (not shown) mounted on its top surface. The rotatable handle 302 engages the ring so as to rotate along the ring until a stop within the handle 302 engages one of two stops formed on the ring. The two stops on the ring are angularly separated from one another by approximately 180°. When the rotatable handle 302 engages one of the stops the distal end of the tab 304 is pointed downward so as to be aligned with the zipper. This allows one to grip the tab 304 and pull down so as to open the zipper. To close the zipper, one rotates the handle 302 by 180° until it engages the other stop. At this position, the distal end of the tab 304 is pointed upward and aligned with the zipper so that the tab 304 can be grabbed and pulled upward resulting in the closure of the zipper.

Figure 5A:
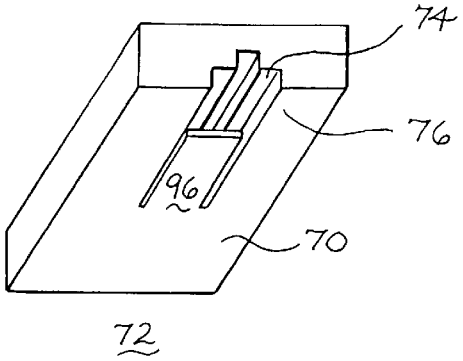
FIGS. 5A–C schematically shows a fourth embodiment of a zipper attachment system to be used with the figurine and zipper system of FIGS. 1A–B.
Figure 5B:
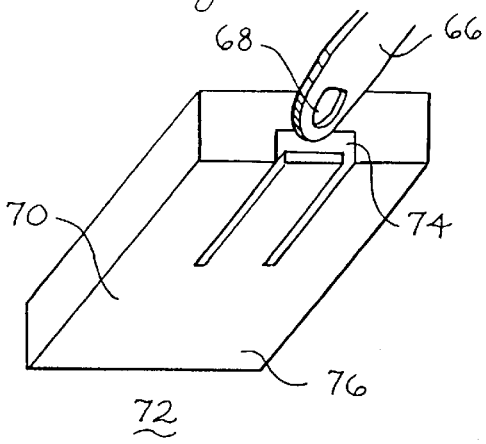
Figure 5C:
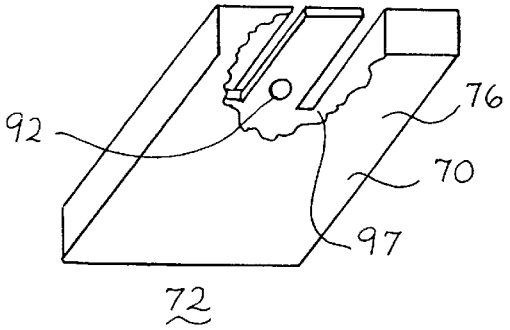
Figure 6A:
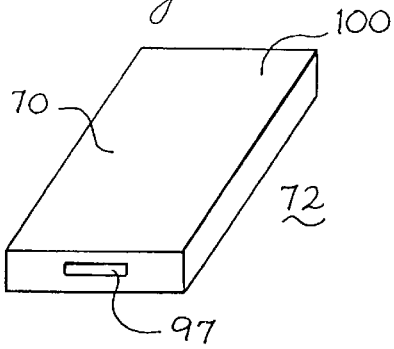
FIG. 6A schematically shows a fifth embodiment of a zipper attachment system to be used with the figurine and zipper system of FIGS. 1A–B.
Figure 6B:
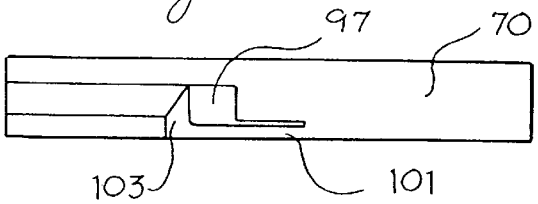
FIG. 6B shows a side cross-sectional view of the zipper attachment system of FIG. 6A.
Figure 6C:
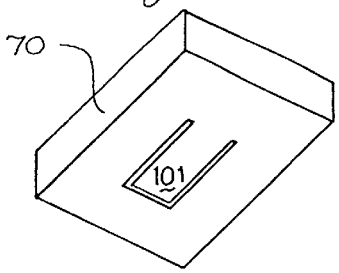
FIG. 6C shows a bottom perspective view of the zipper attachment system of FIG. 6A.

A fourth embodiment of a zipper attachment system 72 is shown in FIGS. 5A–C where a resilient tongue 96 lies adjacent to the slot 74. Below the tongue 94 is a rectangular slot 97 having a thickness that approximately matches that of the handle 66. The handle 66 is inserted into the rectangular slot 97 by bending the tongue 96 upward prior to insertion and lowering the tongue 96 upon insertion. Lowering the tongue 96 causes a protrusion 92 that is integrally attached to the underside of the tongue 96 through the opening 68 so that the handle 66 cannot be removed from the rectangular slot 97 until the tongue 96 is bent upward. In a related variation shown in FIGS. 6A–C, the tongue 96 is eliminated so that the rectangular slot 97 remains. As shown in FIG. 6C, a rectangular flexible portion 101 is formed in the bottom of the mounting portion 70. As shown in FIG. 6B, the flexible portion 101 overlaps the slot 97 so that a spring loaded protrusion 103 is placed inside the slot 97 so that it engages the opening 68 when the handle 66 is inserted into the rectangular slot 97.

Other variations for the mounting piece 70 are possible. For example, in the embodiments of FIGS. 2–6, the mounting piece 70 is slid in the slot 74 as described previously. One difference with the other embodiments is that the strap 80 is eliminated. The handle 66 is attached to the mounting piece 70 by laying the handle 66 flat on the exterior surface 76 so that the opening 68 is aligned with the hole 94 and a fastener, such as screw, is inserted through the opening 68 and screwed into the hole 94.

Figure 7A:
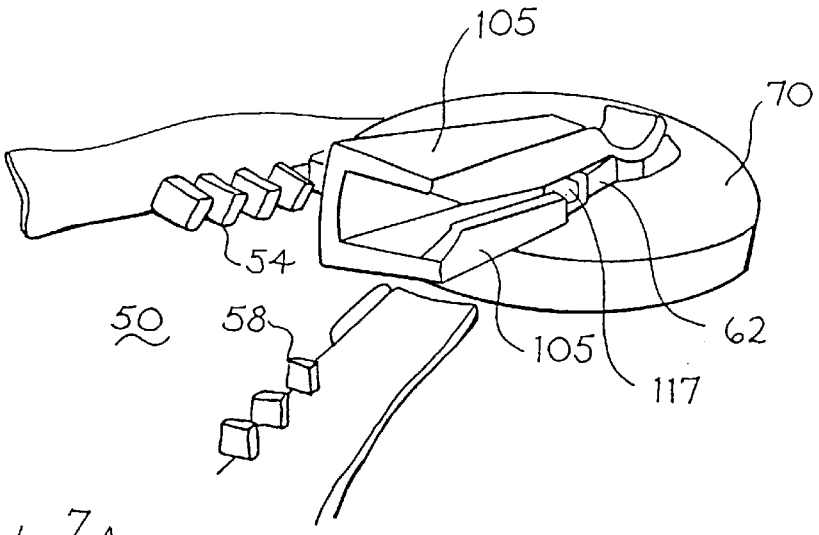
FIG. 7A schematically shows a front perspective view of a sixth embodiment of a zipper attachment system to be used with the figurine and zipper systems of FIGS. 1–6.
Figure 7B:
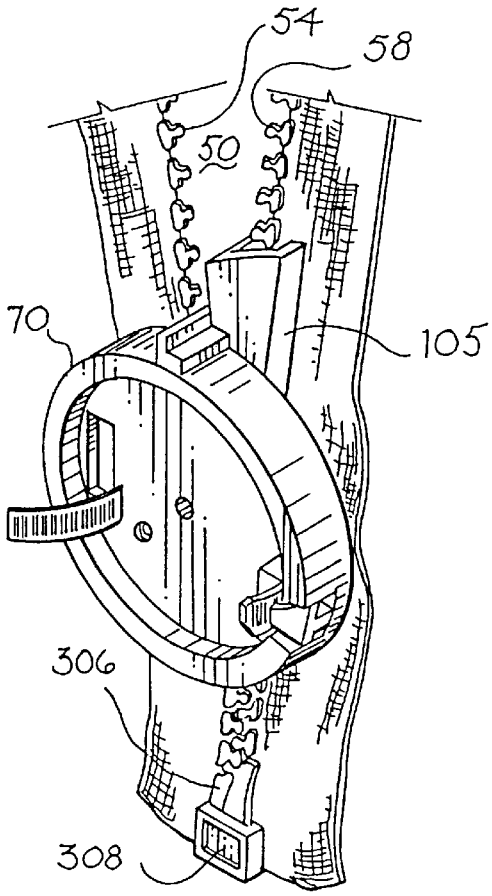
FIG. 7B schematically shows a top perspective view of the zipper attachment system of FIG. 7A.
Figures 7C, 7D, 7E:
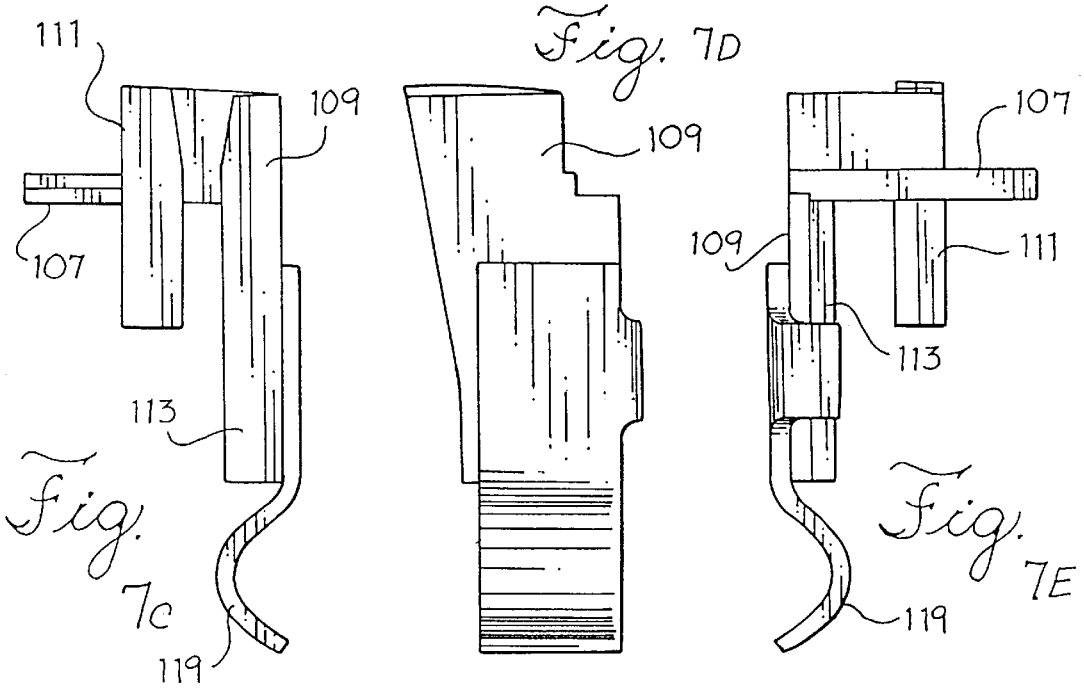
FIG. 7C shows a right side view of a funnel to be used with the zipper attachment system of FIGS. 7A–B.
FIG. 7D shows a bottom view of the funnel of FIGS. 7A–B.
FIG. 7E shows a left side view of the funnel of FIGS. 7A–B.
Figure 7F:
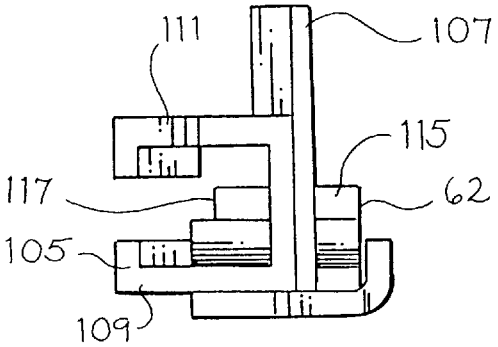
FIG. 7F shows a front view of the funnel of FIGS. 7A–B.
Figure 7G:
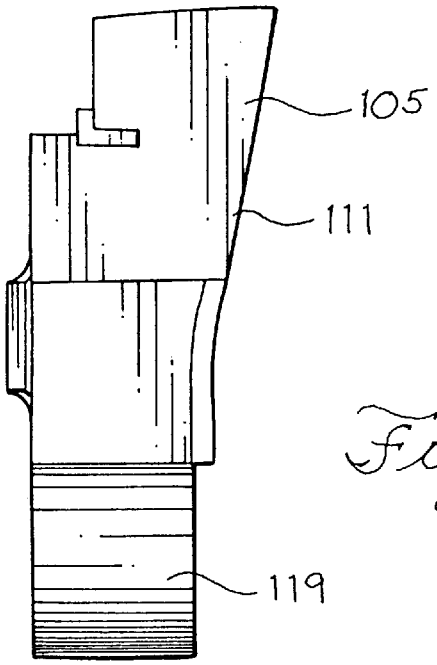
FIG. 7G shows a top view of the funnel of FIGS. 7A–B.
Figure 7H:
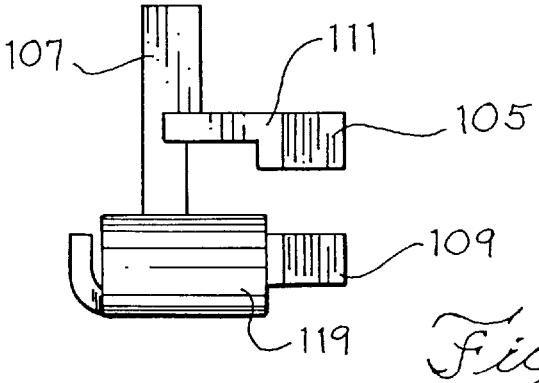
FIG. 7H shows a rear view of the funnel of FIGS. 7A–B.

Another variation of the mounting piece 70 is shown in FIGS. 7A–H. The mounting piece 70 is attached to a zipper attachment system 50 that includes two rows of teeth 54 and 58 which are inserted into a sliding piece 62 and are interlocked by the sliding piece 62 in a manner as described previously. In order to improve starting the attachment of the two rows of teeth 54 and 58, a plastic funnel 105 is attached to the mounting piece 70 by applying glue to a post 107 of the funnel 105. The funnel 105 is C-shaped having a bottom side 109 and a top side 111 which define an opening into which the first row of teeth 54 is inserted. The mounting piece 70 is placed on top of and attached to the top side 111 of the funnel 105. The bottom side 109 extends past the top side 111 so that a platform area 113 is formed. The sliding piece 62 is placed on the platform area 113 so that its handle 66 is positioned between the mounting piece 70 and the rows of teeth 54 and 58. As shown in FIGS. 7A and 7F, the left opening 115 of the sliding piece 62 is laterally offset from the post 107 so that the row of teeth 58 can be inserted into the left opening 115. The right opening 117 of the sliding piece 62 is aligned with the funnel opening so that the row of teeth 54 is first inserted through the funnel opening and into the right opening 117. The funnel 105, thus, guides the row of teeth 54 into the sliding piece 62 and allows for easier insertion of a row of teeth into a sliding piece.

Insertion of the row of teeth is further improved via a plastic spring 119 attached to the bottom side 109 of the funnel 105. It is well known that when the rows of teeth 54 and 58 are totally unattached from each other, the sliding piece 62 is attached to the row of teeth 58 while the other row of teeth 54 is unattached to the sliding piece 62. To begin attachment, a rectangular insertion piece 306 positioned at an end of the row of teeth 54 needs to be inserted through the funnel opening and the right opening 115 and into a slotted bracket 308 formed at an end of the row of teeth 58 and which is held in position by lifting up the plastic spring 119 from the zipper, positioning the bracket 308 below the spring 119 and then lowering the spring 119 until it presses down on the bracket 308. At this position, the position of the bracket 308 is stabilized so that the insertion piece 306 can be inserted into the bracket without fear that the bracket 308 will move during the insertion process. It is noted that the slotted bracket 308 prevents the sliding piece 62 from being removed from the end of the row of teeth 54 where the bracket is located.

It is understood that other variations of the zipper attachment system 50 of FIGS. 7A–G are possible without departing from the spirit of the invention. For example, the sliding piece 62 can be mounted on the row of teeth 58 and the funnel 105 can be positioned so as to receive the row of teeth 54. Furthermore, a ribbed strap can be inserted through two openings formed in the mounting piece 70 so that it is attached thereto, wherein the strap is forms a loop into which the handle 66 is inserted. The handle 66 is attached to the mounting piece 70 by pulling on the strap and closing the loop so that the strap presses the handle 66 against the mounting piece 70.

Each of the mounting pieces 70 shown in FIGS. 2–7 are used to support either a fixed two dimensional figurine or a movable three dimensional figurine 98 attached to an exterior surface 100 that faces away from the exterior surface 76. An example of a fixed two dimensional figure that may be attached to the mounting pieces of FIGS. 2–7 is shown in FIGS. 7A-B where the figurine 98 is painted on the mounting piece 70 or is formed on a surface of an adhesive label and the label is placed on the exterior surface 100.

Movable three dimensional figurines 98 may be attached to the mounting pieces 70 of FIGS. 2–7 as well. Movement of the figurines 98 can be accomplished by having the mounting piece 70 interact with the zipper 52. As shown in FIGS. 1A–B, the mounting piece 70 includes a second slot 102 with a pair of notches 104 that receive a coupling mechanism such as driving wheel 106 with a rubber outer coating. As explained in detail below, the driving wheel 106 generates a first type of motion in response to but separate to the translational movement of the sliding piece 62 of the zipper 52 along the direction 64 so that the generated first type of motion causes a portion of the figurine 98 to move. Thus, the driving wheel 106 is used to convert the translational movement of the sliding piece 62 of the zipper 52 into a separate type of movement which causes the figurine 98 to move.

As shown in FIG. 1A, the driving wheel 106 engages the area occupied by the interlocked first and second rows of teeth 54 and 58. As the sliding piece 62 is moved along or opposite to the direction 64, the driving wheel 106 will engage the teeth 54 and 58 by rolling thereon. Thus, the driving wheel 106 rotates about an axis that is substantially perpendicular to the direction of translational movement of the sliding piece 62. Rotation of the driving wheel 106 can be used to cause a wide variety of movements for the figurine 98. As shown in FIGS. 1A–B, the figurine 98 is an animal figurine such as in the form of a horse that can be pivoted by attaching a rod 108 to the driving wheel 106. The rod 108 may be made of plastic and have an end that is C-shaped so as that an axle 121 is inserted into the C-shaped end so that the axle 121 is clipped thereon. The rod 108 is attached via a pin 110 to both a head piece 112 that pivots about point 114 and a tail piece 116 that pivots about point 118. As the driving wheel 106 rotates, the rod 108 linearly moves up along direction 120 which causes the head piece 112 to pivot counterclockwise and the tail piece 116 to pivot clockwise about axes that are parallel to the axis of rotation of the driving wheel 106. Further rotation of the driving wheel 106 causes the rod 108 to reverse its linear motion which in turn causes the head piece 112 to pivot clockwise and the tail piece 116 to pivot counterclockwise.

Figure 8:
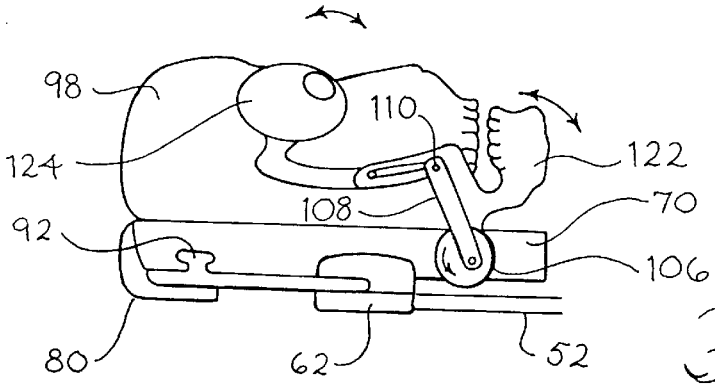
FIG. 8 schematically shows a figurine and zipper system where the figurine is a skull.

The driving wheel 106 allows for movement of a wide variety of figurines. As shown in FIG. 8, the horse figurine of FIGS. 1A–B is replaced by a figurine of an animal's head in the shape of a skull. The rod 108 is attached to both a jaw piece 122 and an eyeball piece 124 via a pin 110. As the rod 108 moves either upward or downward, the jaw piece 122 and the eyeball piece 124 pivot in a manner that corresponds to the movement of the head piece 112 and the tail piece 116, respectively, as described above with respect to FIGS. 1A–B.

Figure 9A:
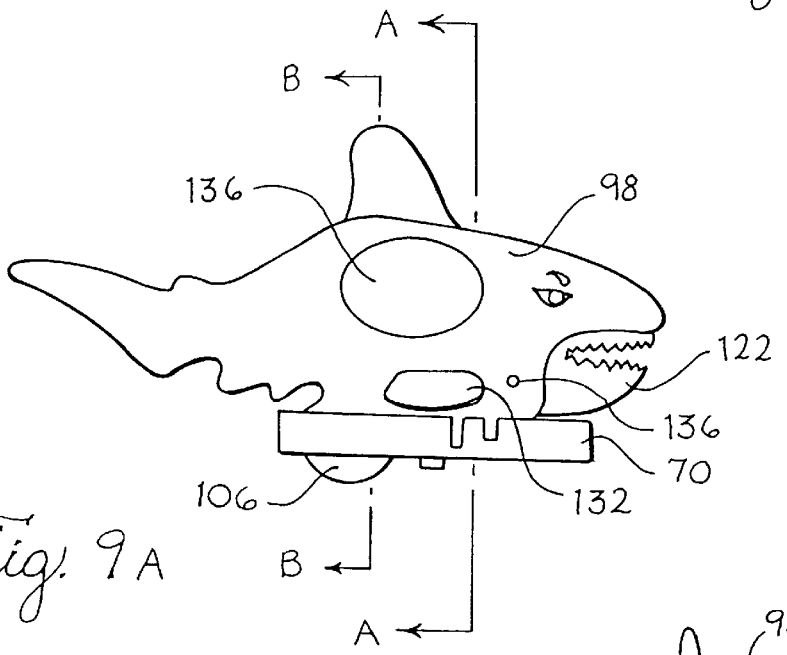
FIG. 9A schematically shows a side view of an embodiment of a figurine and zipper system where the figurine is a shark.
Figure 9C:
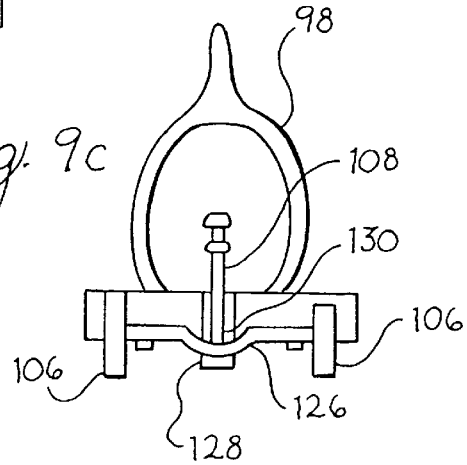
FIG. 9C shows a cross-sectional view taken along line B of the figurine and zipper system of FIG. 9A.
Figure 9B:
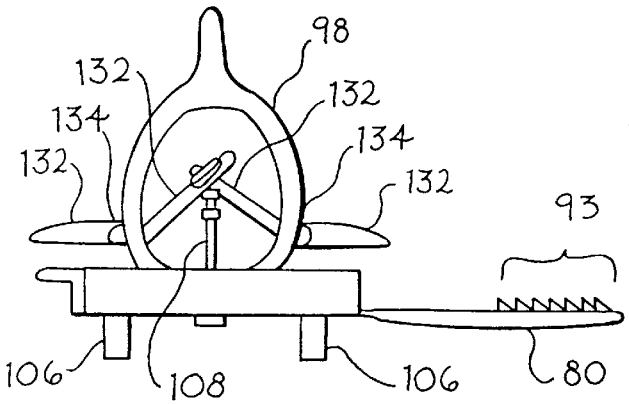
FIG. 9B shows a cross-sectional view taken along line A of the figurine and zipper system of FIG. 9A.
Figure 9D:
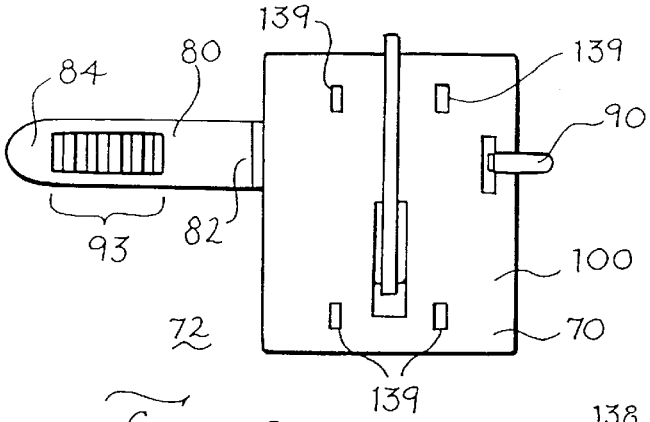
FIG. 9D shows a top view of a zipper attachment system to be used with the figurine and zipper system of FIGS. 9A–C.
Figure 9E:
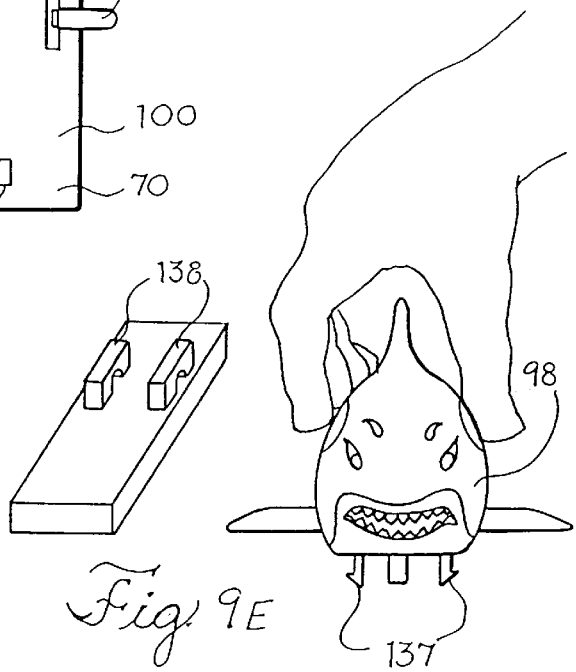
FIG. 9E shows the figurine and zipper system of FIG. 9A when the shark figurine has been detached from the mounting piece.
Figure 9G:
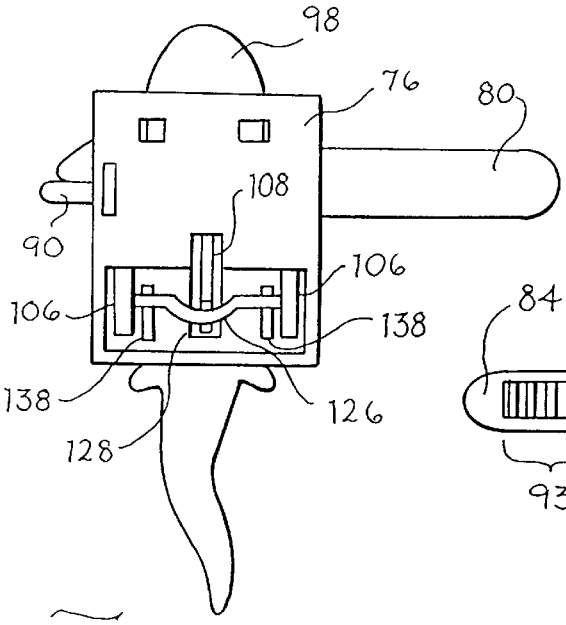
FIG. 9G shows a bottom view of the figurine and zipper system of FIG. 9A.
Figure 9F:
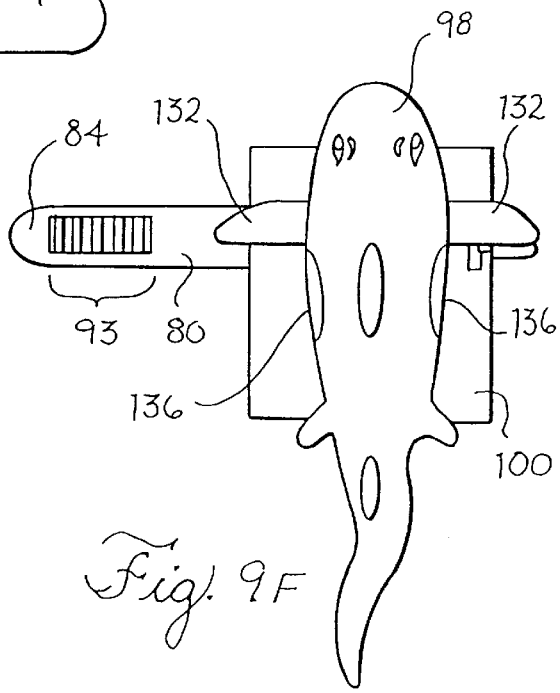
FIG. 9F shows a top view of the figurine and zipper system of FIG. 9A.

It is understood that it is possible to move the second slot 102 such that the driving wheel 106 will roll either on material 56 or material 60 without departing from the spirit of the invention. In fact, it is possible to use more than one driving wheel 106. As shown in FIGS. 9A–H, a pair of driving wheels 106 are positioned on either side of the interlocking rows of teeth 54 and 56 so that the driving wheels 106 roll on the first and second materials 56 and 60. The driving wheels 106 are coupled together by a common axle 126 that is rotatably attached to the C-shaped brackets 138. As shown in FIGS. 9C and 9G, the axle 126 has an indentation 128 located midway between the driving wheels 106. The axle 126 is inserted through an eyelet 130 at one end of a rod 108 so that the rod 108 is attached to the axle 126 at the indentation 128. The other end of the rod 108 is attached to a pair of fin elements 132 of a figurine 98 of an aquatic animal attached to the mounting piece 70, such as a shark, that pivot about pivot points 134. As the driving wheels 106 rotate, the indentation 128 moves up and down. This causes rod 108 to move up and down which in turn causes the fin elements 132 to pivot up and down about axes that are perpendicular to the axes of rotation of the driving wheels 106. It is also possible to attach a pivoting jaw element 122 to the rod 108 in a manner similar to fin elements 132 so that the jaw element 122 pivots about a pivot point 136. Furthermore, indentations 136 may be placed on the sides of the figurine 98 to aid in holding the figurine 98 when it is moved along the zipper 52. The indentations 136 also aid in attaching the figurine 98, by having four plastic clips 137 inserted into corresponding holes 139 as shown in FIG. 9D.

Another way to convert the translational motion of the zipper 52 into movement of a figurine 98 is to insert a cam wheel 140 in the mounting piece 70 so that the cam wheel 140 engages the driving wheel 106. The cam wheel 140 is also attached to the figurine 98 so that rotation of the driving wheel 106 causes the cam wheel 140 to rotate which causes a portion of the figurine 98 to move. As shown in FIGS. 10A–B, a pair of rods 108 are attached via a pin 142 to the cam wheel 140. Rotation of the cam wheel 140 causes both a jaw element 122 and a tail element 116 of a figurine 98 in the shape of a dog to pivot about pivot axes 144 and 146, respectively, that are parallel to an axis of rotation of the driving wheel 106.

The mechanism shown in FIGS. 10A–B, can be used in other ways. For example, a jaw element 122 and an eyeball element 124 of a figurine 98 in the shape of a skull are pivoted about pivot points 144 and 148, respectively, via rods 108 as shown in FIG. 11. Again, the rods 108 are attached to a rotating cam wheel 140 which is caused to rotate by driving wheel 106. Note that the driving wheel 106 and cam wheel 140 may be located near the jaw element 122 or beyond the eyeball element 124.

Another embodiment similar to the embodiments of FIGS. 10A–B and 11 is shown in FIG. 12, where the cam wheel 140 is rotated by the driving wheel 106. The rods 108 are moved by the cam wheel 140 which cause the pivoting of the head element 112 and the tail element 116 of a figurine 98 in the shape of a horse.

Figure 13A:
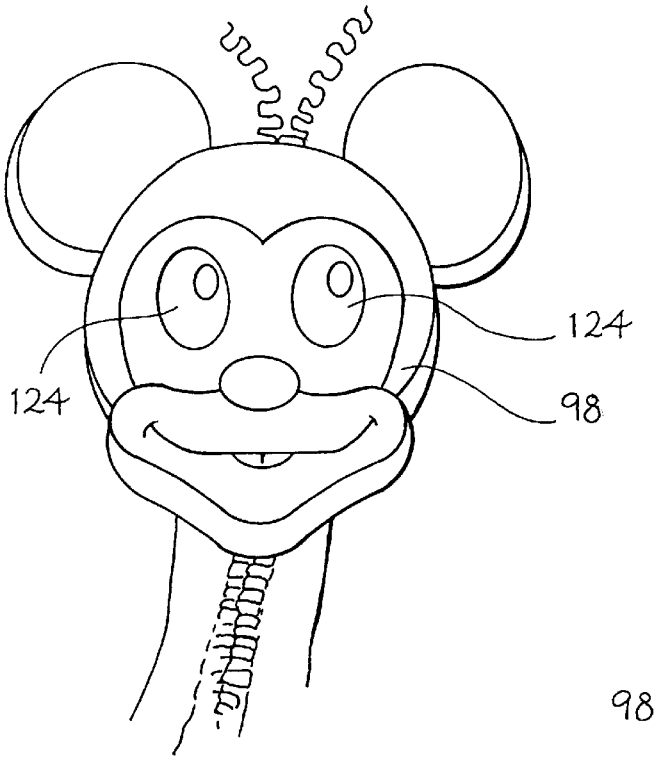
FIG. 13A shows a top view of an embodiment of a figurine and zipper system where the figurine is the head of a mouse.
Figure 13B:
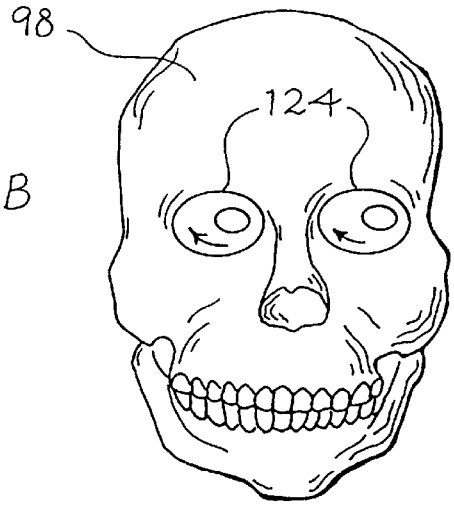
FIG. 13B schematically shows a top view of an embodiment of a figurine and zipper system where the figurine is a skull.
Figure 14:
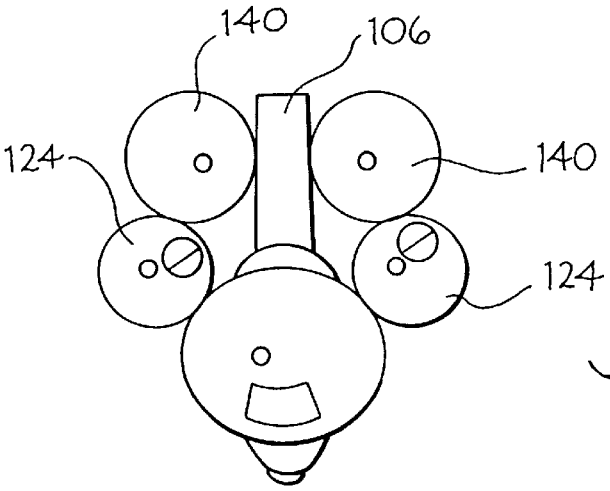
FIG. 14 schematically shows a top sectional view of the movement generating system used in the embodiments of FIGS. 13A–B.

It is also possible to have the eyeball pieces 124 of a figurine 98, such as the mouse of FIG. 13A or the skull of FIG. 13B, move so that it appears that the eye rolls. As shown in FIG. 14, the driving wheel 106 engages a pair of cam wheels 140 that rotate about corresponding axes that are perpendicular to the axis of rotation of the driving wheel 106. Each cam wheel 140 engages an eyeball piece 124 that rotates about an axis that is parallel to that of the corresponding cam wheel 140. Operation of the mouse and skull of FIGS. 13A–B is as follows: movement of the sliding piece 62 of the zipper 52 causes the driving wheel 106 to rotate which causes the cam wheels 140 to rotate which in turn causes the cam wheels A of the eyeball pieces 124 to rotate. The cam wheels A can be used to press a lever which causes a mouth to open or another element of the figurine to move. It is understood that other figurines, such as a dog, can be made that roll their eyes.

Figure 15:
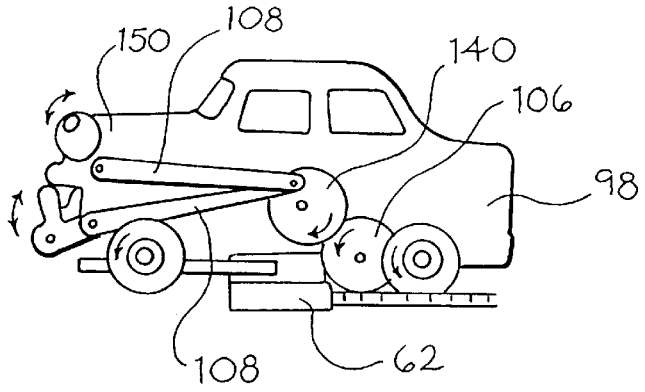
FIG. 15 schematically shows an embodiment of a figurine and zipper system where the figurine is a car.

Another variation is shown in FIG. 15, where the figurine 98 attached to the mounting piece 70 is a motor vehicle. The rods 108 are attached at a common point on the cam wheel 140 and move so as to pivotally move a hood 150, the head light eyes and the bumper mouth of an animated motor vehicle.

Figure 16A:
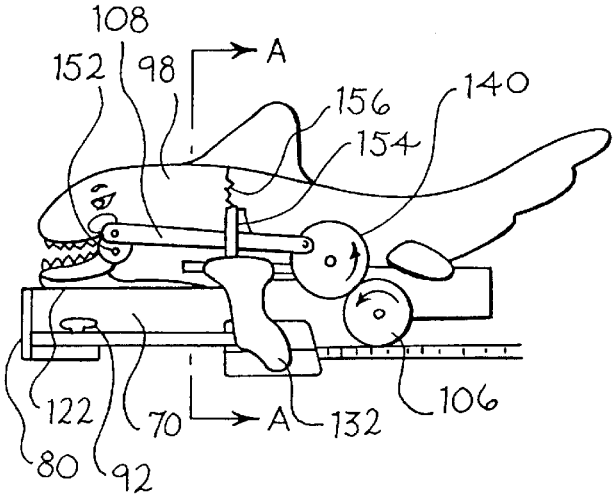
FIG. 16A schematically shows a side cross-sectional view of an embodiment of a figurine and zipper system where the figurine is a shark.
Figure 16B:
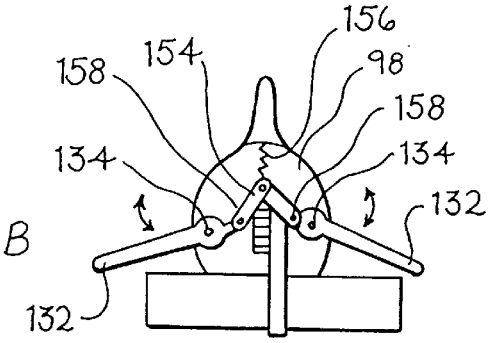
FIG. 16B shows a cross-sectional view taken along lines A—A of FIG. 16A.
Figure 17:
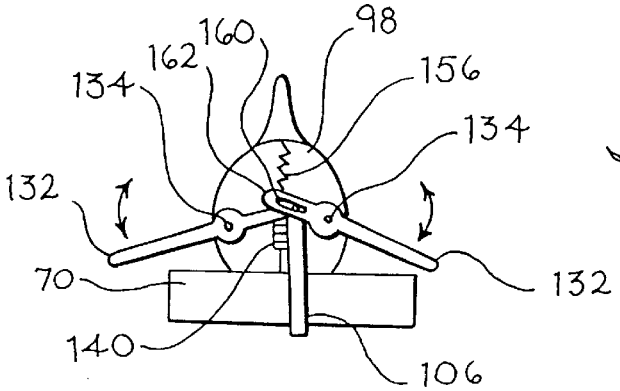
FIG. 17 schematically shows front cross-sectional view of a second embodiment of the figurine and zipper system of FIGS. 16A–B.

Another embodiment of the present invention is shown in FIGS. 16A–B. In particular, a figurine of an aquatic animal, such as a shark, is attached to the mounting piece 70. A cam wheel 140 engages the driving wheel 106 so that it rotates and moves a rod 108 attached thereto. The end of the rod 108 furthest from the cam wheel 138 is attached a jaw element 122. Movement of the rod 108 causes the jaw element 122 to pivot about pivot point 152. In addition, the rod 108 contacts an inverted V-shaped bracket 154 during a portion of the rotation of the cam wheel 140. The inverted V-shaped bracket 154 is attached to the figurine 98 via a spring 156. A pair of fin elements 132 are attached to each end of the bracket 154 by pins 158 so that the fin elements 132 are able to pivot with respect to the bracket 154. The fin elements 132 are set in motion when the rod 108 moves upward and contacts the bracket 154 which causes the fin elements 132 to pivot downward. When the rod 108 is lowered so that it no longer contacts the bracket 154, the spring 156 will cause the bracket 154 to oscillate up and down. Consequently, the fin elements 132 will pivot up and down as well. Note that it is possible to replace bracket 154 and have the fin elements 132 attached to each other via a pin 160 inserted through slots 162 located in each end of the fin element 132 position with the body of the figurine as shown in FIG. 17.

In each of the embodiments of FIGS. 10–12 and 15–17, the driving wheel 106 rotates about an axis that is parallel to the axis of rotation of the cam wheel 140. However, as shown with the rolling eye embodiments of FIGS. 13A–B it is possible to move a portion of the figurine 98 by using a cam wheel 140 that rotates about an axis of rotation that is perpendicular to the axis of rotation of the driving wheel 106. Another example of such a motion is shown in FIGS.

18A–B where the dog figurine of FIGS. 10A–B has been modified by attaching the rod 108 of the tail element 116 to a second cam wheel 164 that rotates about an axis perpendicular to the rotation axis of the driving wheel 106. Rotation of the driving wheel 106 causes the second cam wheel 164 to rotate which causes the tail element 116 to pivot from side to side instead of up and down as in the embodiment of FIGS. 10A–B.

Figure 19C:
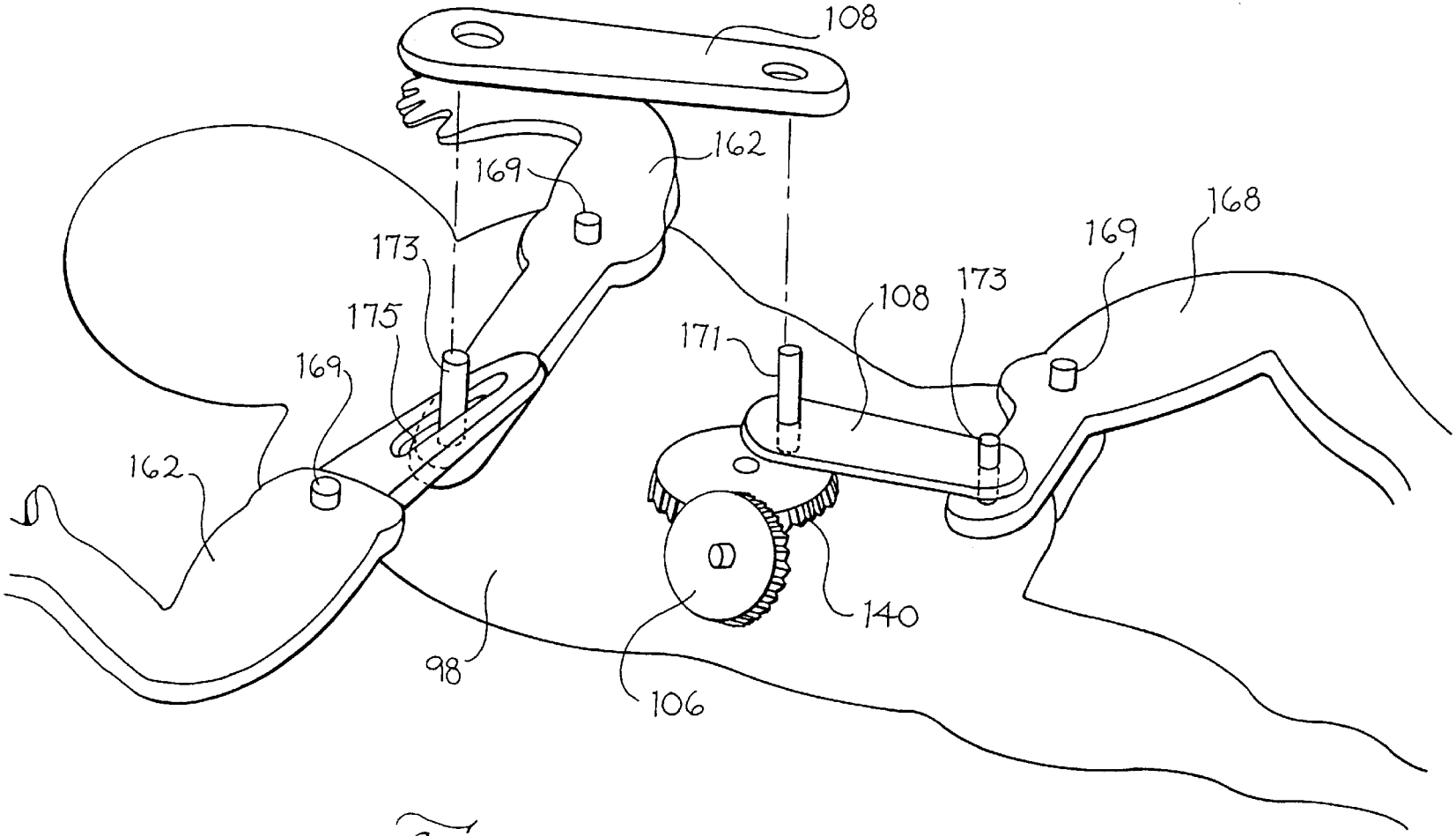
FIG. 19C schematically shows an enlarged and partially exploded view of the figurine and zipper system of FIG. 19B.

Another embodiment of a figure and zipper system that uses a second cam wheel is shown in FIGS. 19A–C where a figurine 98 in the shape of a person is used The figurine 98 is attached to the mounting piece 70 so that the movable arms 162 of the figurine 98 are located in front of the sliding piece 62 and the movable leg 168 are located behind the mounting piece 70. The movable arms 162 and movable leg 168 have holes throughwhich pivoting pins 169 are inserted so as to allow the arms and leg to pivot thereabout. As shown in FIG. 19C, the driving wheel 106 engages a cam wheel 140 which is connected to rods 108, via pin 171 attached to cam wheel 140, which in turn are connected to the pins 173 of arms 162 and leg 168. Note that the arms 162 are linked together by having the pin 173 attached to the left arm inserted through an elongated slot 175 formed in the right arm.

The embodiments of FIGS. 20 and 21 show how the cam wheel 138 can cause a figurine such as a butterfly (FIG. 20) or a bee (FIG. 21) to move in an arcuate path from one end of the mounting piece to the other. In each embodiment, a driving wheel 106 rotates a cam wheel 140 in a manner as described previously. The cam wheel 140 has a pin 172 that is inserted through and retained within a slot 174 formed in rod 108. The rod 108 is pivotally attached to the mounting piece 70 via a second pin 179. Rotation of the cam wheel 140 causes the figurine to rise and fall and pivot from the left and right as shown in FIGS. 20–21. In another embodiment, the slot 174 engages the pin 179 instead of the pin 172.

Figure 22:
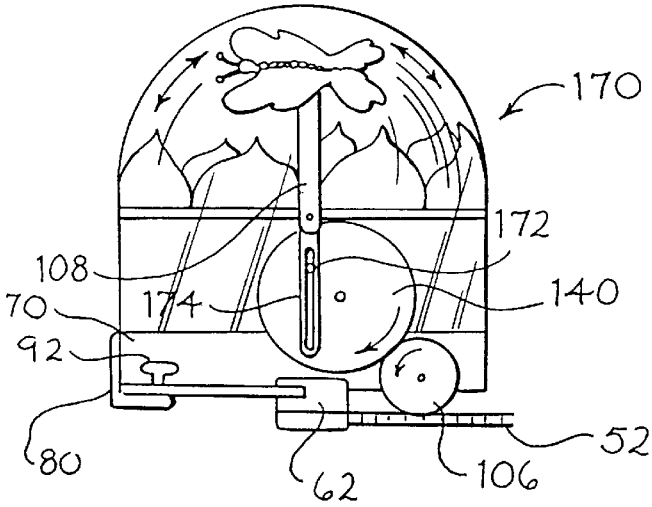
FIG. 22 schematically shows a side cross-sectional view of an embodiment of a figurine and zipper system where the figurine is a butterfly.

Another example of where the driving wheel 106 and the cam wheel 140 can cause a figurine to translationally move in a direction perpendicular to the direction 64 of the zipper 52 is shown in FIG. 22. The figurine 98 is in the form of a butterfly that is contained within a clear bubble 170 attached to the edges of the mounting piece 70. The rod 108 is attached to the cam wheel 140 via a pin 172 that slides along slot 174 so that the butterfly moves up and down as the cam wheel 140 rotates. The rod 108 is pivotally attached to the mounting piece 70 via a second pin 179. Rotation of the cam wheel 140 causes the figurine to rise and fall as shown in FIG. 22. In another embodiment, the slot 174 engages the pin 179 instead of the pin 172.

Another embodiment where the figurine is able to translationally move up and down in a direction perpendicular to the direction 64 of the sliding piece 62 is shown with the carousel 176 of FIGS. 23A–E. The mounting piece 70 is cylindrical in shape and has a circular opening 178 on top. A lower circular platform 180 is attached via a shaft 182 to an upper circular platform 184. The lower circular platform 180 is placed over the circular opening 178 so that the shaft 182 engages a notch (not shown) formed in the bottom of the mounting piece 70. The lower end of the shaft 182 may be threaded so as to be screwed into a tapped hole formed in the platform 180. The underside of the lower platform 180 is in contact with the driving wheel 106 so that rotation of the wheel 106 will cause both of the platforms 180 and 184 to rotate about the axis defined by the shaft 182 that is able to rotate. Note that both ends of the axle of the driving wheel 106 are inserted into the openings 185 of a pair of clips 197 located in the bottom of the mounting piece 70 (See FIGS. 23D–E).

Figure 23A:
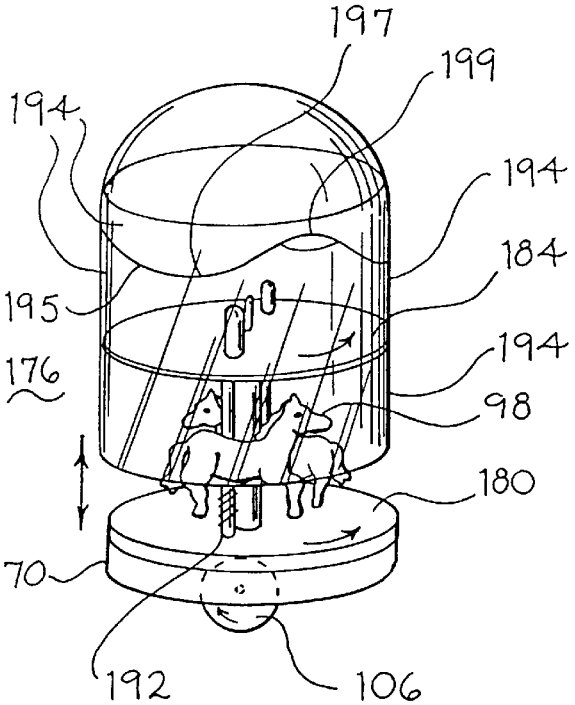
FIG. 23A schematically shows an embodiment of a figurine and zipper system where a figurine is rotated upon a carousel.
Figure 23B:
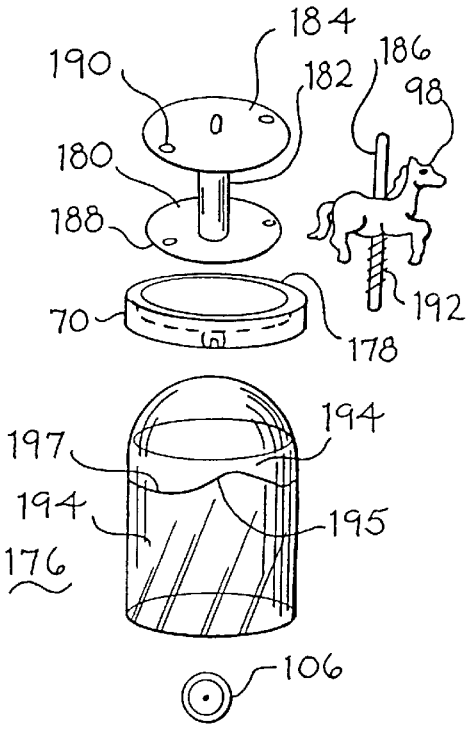
FIG. 23B schematically shows an exploded view of the figurine and zipper system of FIG. 23A.
Figure 23C:
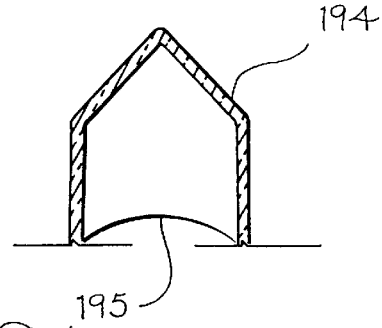
FIG. 23C shows sectional view of a cover to be used with the figurine and zipper system of FIGS. 23A–B.
Figure 23D:
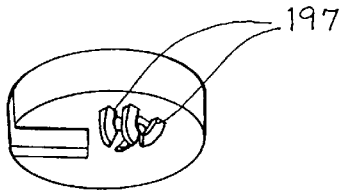
FIG. 23D shows a bottom perspective view of the mounting piece used for the figurine and zipper system of FIGS. 23A–B.
Figure 23E:
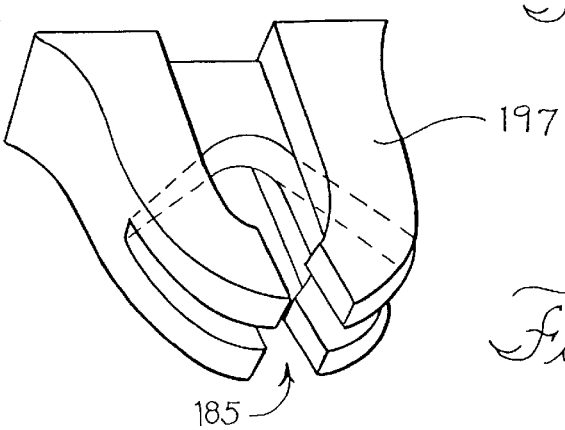
FIG. 23E shows an enlarged perspective view of an attachment piece attached to the bottom of the mounting piece of FIG. 23D.

A figurine 98 in the shape of a carousel horse is attached to the lower circular platform 180 by inserting both ends of the pole 186 through corresponding holes 188 and 190 formed in the platforms 180 and 182, respectively. A spring 192 is inserted over the bottom of the pole 186 so that the spring 192 lies on the platform 180 (FIGS. 23A–B) or below the platform 180. A clear plastic cover 194 may be placed over the platforms 180 and 184 and attached to the mounting piece 70 via an adhesive such as glue. As shown in FIGS. 23A and 23C, the cover 194 has a curved sinusoidal-like shaped perimeter 195 that acts as a cam. The curved perimeter 195 contacts the top of the pole 186 at the lower extremity 197 so as to press the pole 186 downward. This results in the compression of the spring 192. When the curved perimeter 195 is rotated so that the upper extremity 199 is above the pole 186, the pole 186 no longer makes contact with the perimeter 195 and the spring 192 decompresses resulting in the pole 186 and the figurine 98 to oscillate up and down until the pole 186 makes contact with the next lower extremity where the above process is repeated.

Operation of the carousel 176 is straight forward. When the sliding piece 62 is translationally moved, the driving wheel 106 rotates in the manner described above. The driving wheel 106 is in contact with the underside of the lower platform 180 so that when the driving wheel 106 rotates it causes the platform 180 and the figurine 98 to rotate about the shaft 182. As the figurine 98 rotates, it will pass over the location of the driving wheel 106. When it does so, the driving wheel 106 will contact and push up the lower end of the pole 186. When the driving wheel 106 no longer contacts the pole 186, the pole 186 falls through the hole 188 and the spring 192 causes the horse to oscillate up and down.

Figure 24A:
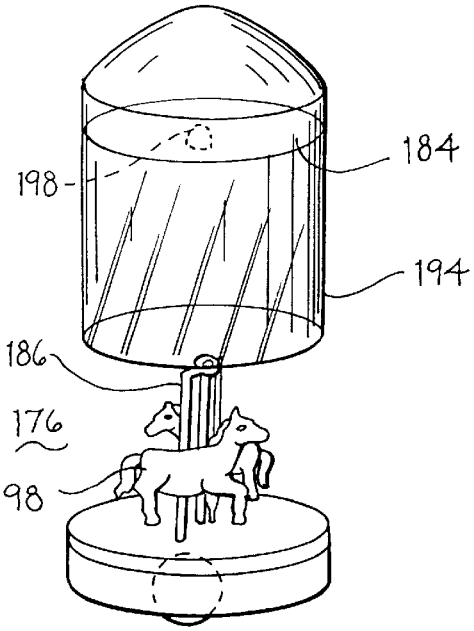
FIG. 24A schematically shows a second embodiment of a figurine and zipper system where a figurine is rotated upon a carousel.
Figure 24B:
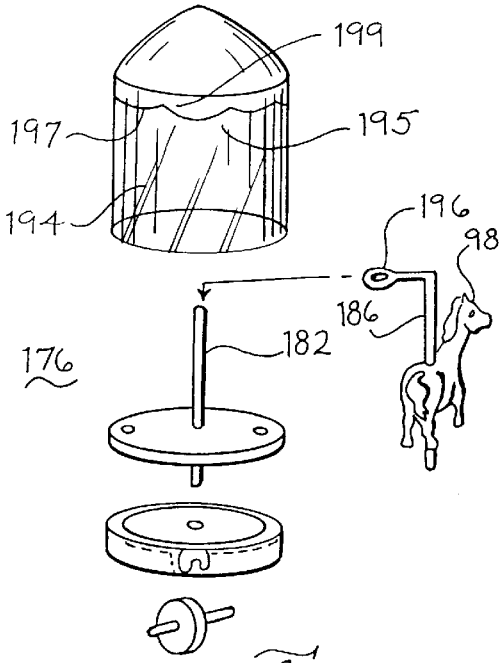
FIG. 24B schematically shows an exploded view of the figurine and zipper system of FIG. 24A.

A second embodiment of the carousel 176 of FIGS. 23A–E is shown in FIGS. 24A–B. As can be seen there are several differences between the embodiments. First, the top of the pole 186 is bent so that a looped end 196 is inserted over the shaft 182. Another difference is that the upper platform 184 is permanently attached to the cover 194 and has a dimple 198 to receive the upper end of the shaft 182.

Figure 25A:
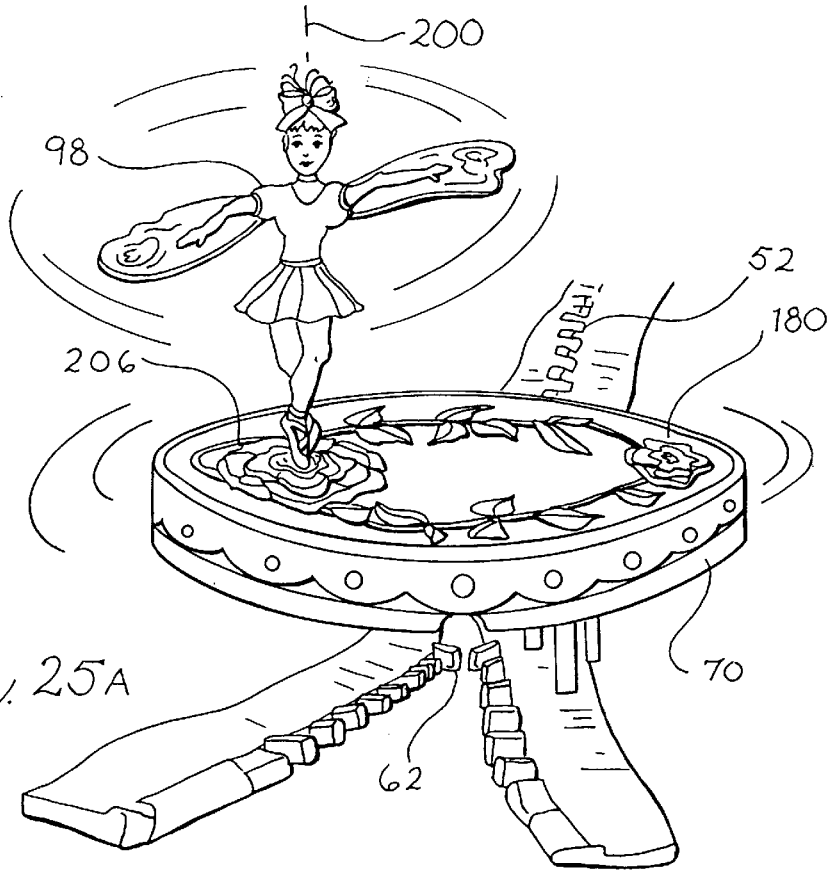
FIG. 25A schematically shows an embodiment of a figurine and zipper system where a figurine in the form of a dancer is rotated.
Figure 25B:
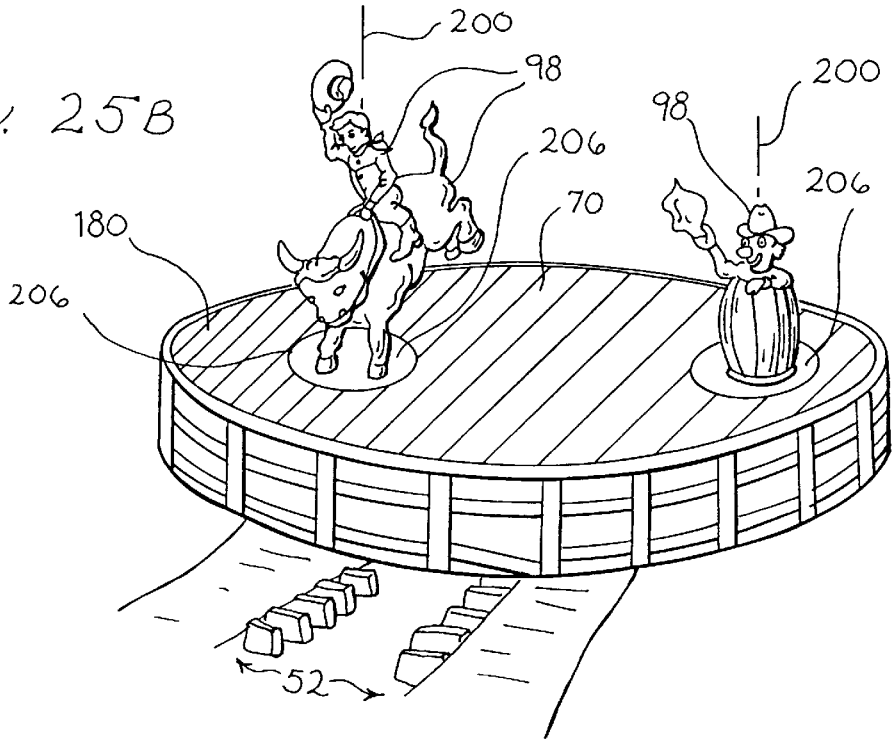
FIG. 25B schematically shows an embodiment of a figurine and zipper system where figurines in the form of a cowboy rider and a clown are rotated.
Figure 25C:
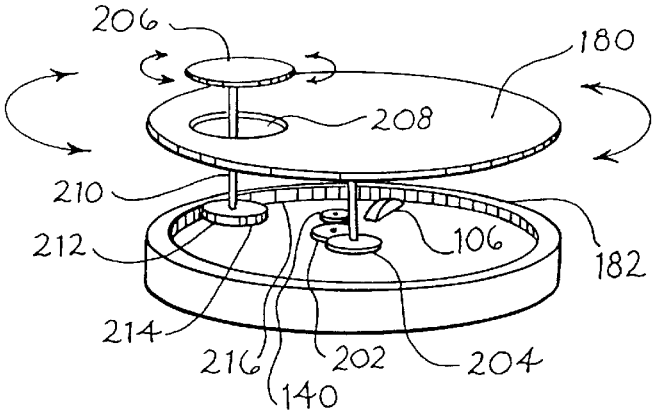
FIG. 25C schematically shows a perspective view of the movement generating system used in the embodiments of FIGS. 25A–B.
Figure 26A:
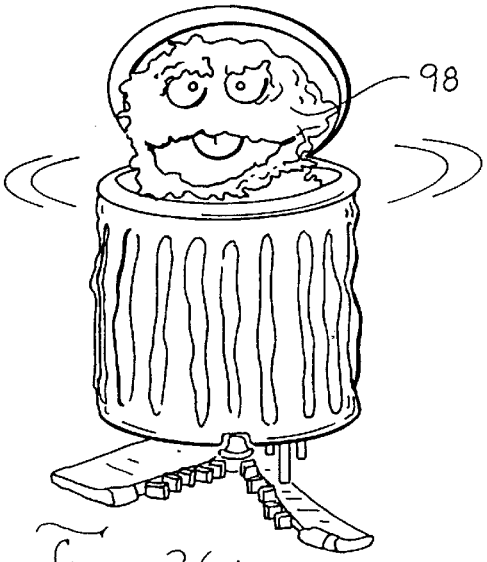
FIGS. 26A–B schematically shows an embodiment of a figurine and zipper system.
Figure 26B:
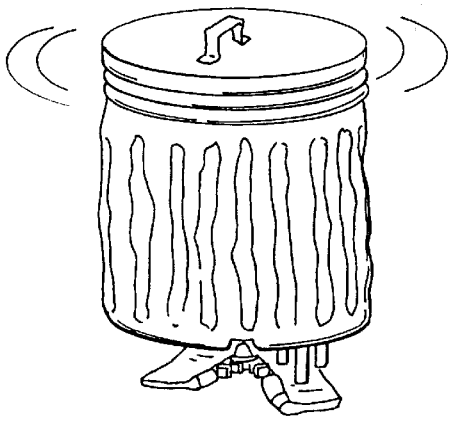

Other variations of the carousel 176 are possible. For example, the upper platform 180 can be removed and the shaft 182 is hidden below the platform 180. As shown in FIGS. 25A–B, rotation of the driving wheel 106 causes an entire figurine 98, in the shape of a dancer (FIG. 25A) or a horse riding cowboy and a clown (FIG. 25B), to rotate with the rotating platform 180 and to spin or rotate about an axis 200 that passes through the figurine and is parallel to the axis of rotation of the platform 180 that is offset from the figurine 98. As shown in FIG. 25C, the figurines 98 and the platform 180 are simultaneously rotated by a multi-cam wheel configuration. As the driving wheel 106 rotates it engages and rotates a first cam wheel 140. Likewise, cam wheel 140 engages and rotates a second cam wheel 202 which engages a third cam wheel 204 that is attached to a shaft 182. Rotation of the second cam wheel 202 causes the third cam wheel 204 and the platform 180 to rotate. Figurine 98 independently spins by being supported on a circular platform 206 that lies within and parallel to a circular hole 208 formed in the platform 180. The platform 206 has an axle 210 and cam wheel 212 attached thereto. As shown in FIG. 25C, the cam wheel 212 has teeth 214 that engage corresponding teeth 216 on the inner circumference of the mounting piece 70. Thus, as the platform 180 rotates the cam wheel 212 engages the teeth 216 of the mounting piece 70 which causes the platform 206 to spin.

Figure 27:
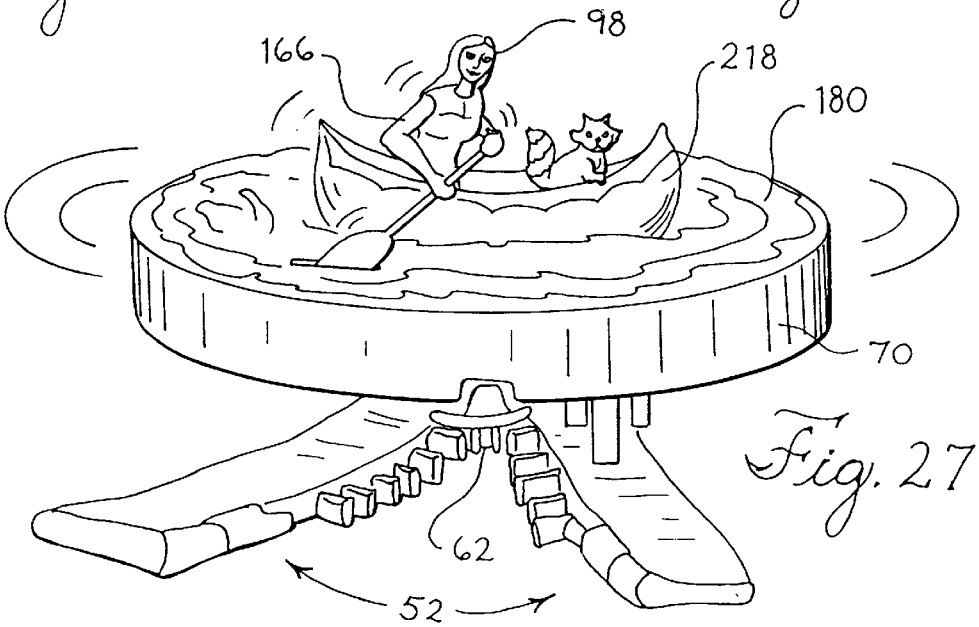
FIG. 27 schematically shows an embodiment of a figurine and zipper system where the figurine is a human rowing a canoe.
Figure 28:
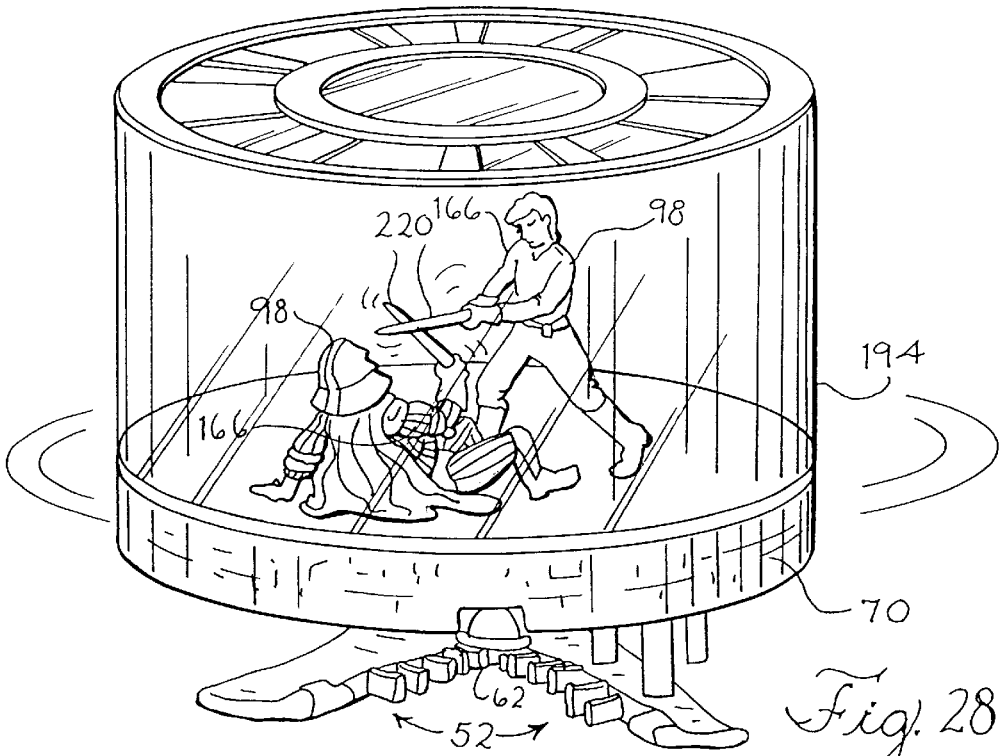
FIG. 28 schematically shows an embodiment of a figurine and zipper system where the figurine rotates and pivots.
Figure 29:
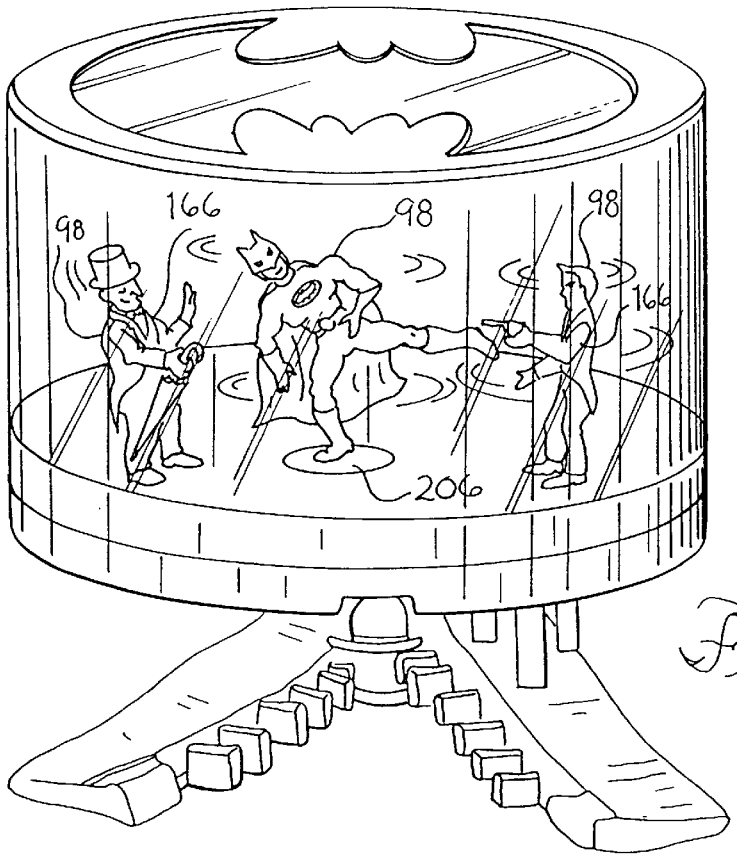
FIG. 29 schematically shows a second embodiment of a figurine and zipper system where the figurine rotates and pivots.

In the embodiments of FIGS. 27–29, the figurine is in the shape of a person where the person rotates with the platform 180 and is able to pivot its arms 166 to paddle a canoe 218 (FIG. 27) or to move an arm 166 and a sword 220 attached thereto (FIG. 28). In addition, multiple figurines can be placed on the platform where some of the figurines pivot their arms while a separate figurine spins as shown in FIG. 29. The structures of the embodiments FIGS. 27–29 are based in large part on the structures previously described with respect to FIGS. 1–26.

Figure 30:
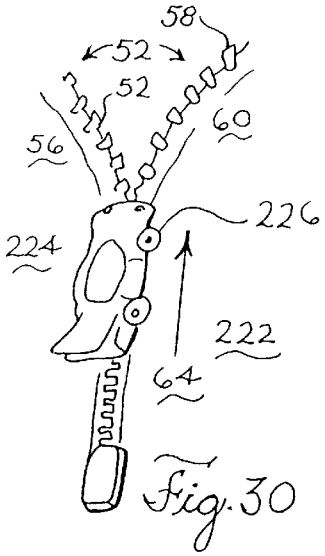
FIG. 30 schematically shows an embodiment of a sound generating zipper system.
Figure 32:
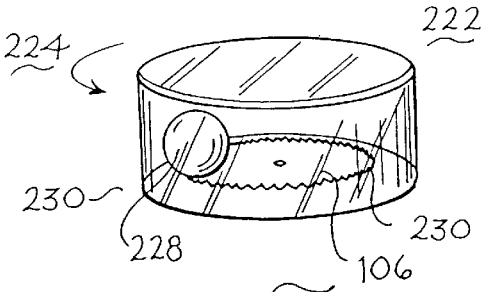
FIG. 32 schematically shows a third embodiment of a sound generating zipper system.
Figure 31:
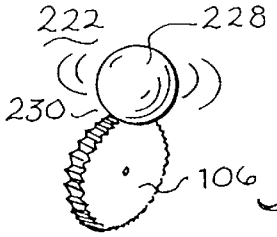
FIG. 31 schematically shows a second embodiment of a sound generating zipper system.

As shown in FIGS. 30–32, another embodiment of the present invention regards a sound generating zipper system 222. The system 222 includes a zipper 52 as described previously which is attached to two pieces of material 56 and 60. As described previously, the sliding piece 62 of the zipper 52 translationally moves along or opposite the direction 64 depending on whether the sliding piece 62 is interlocking or unlocking the first and second rows of teeth 54 and 58. It is well known in the art that a conventional zipper will cause a tearing or "zipping" sound as the teeth are locked or unlocked. To supplant or supplement the zipping sound of the teeth, a sound element 224 is attached to the sliding piece 62 of the zipper 52 in a well known manner, wherein the sound element 224 generates an audible sound which is separate from the zipping sound and which is in response to the translational movement of the zipper 52 along or opposite to the direction 64. The sound element 224 can have many forms without departing from the spirit of the invention. For example, the sound element 224 may include a rotating gear 226 that contacts one or both of the rows of teeth 54 and 58 during the translational movement of the zipper 52 as shown in FIG. 30. The contact between the gear 226 and the rows of teeth 54 and 58 generates an audible sound that is separate from the normal zipping sound caused by the zipper 52.

As shown in FIGS. 31–32, the sound element 222 may include one or more driving wheels 106 and a steel ball 228 located adjacent to or on top of a rim 230 of the driving wheel 106. Each driving wheel 106 engages either the rows of teeth 54 and 58 or the pieces of material 56 and 60 attached to the teeth 54 and 58, respectively, as described previously. When the sliding piece 62 translationally moves, each driving wheel 106 rotates which causes the ball 228 to contact the driving wheel 106 and generate an audible sound which is independent of any zipping sound generated by the zipper 52 itself. The audible sound can be amplified by enclosing the sound element 222 within a sound cone 230.

Figure 33:
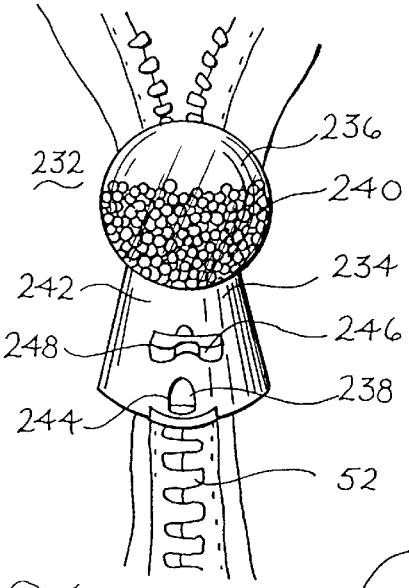
FIG. 33 schematically shows an embodiment of a dispenser and zipper system.
Figure 34:
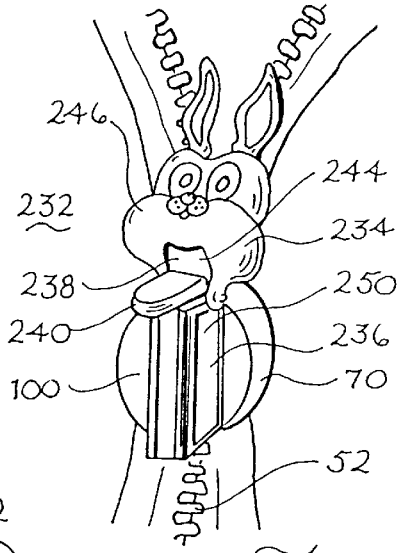
FIG. 34 schematically shows a second embodiment of a dispenser and zipper system.
Figure 35:
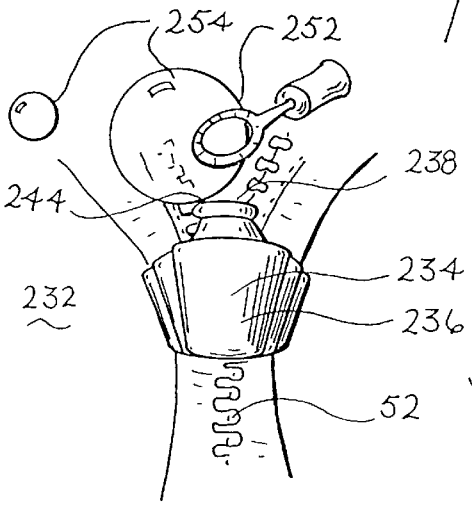
FIG. 35 schematically shows a third embodiment of a dispenser and zipper system.

FIGS. 33–35 show several embodiments of a dispenser and zipper system 232. In each embodiment, a dispenser 234 is attached to a zipper 52. The dispenser 234 includes a container 236 that holds an item. The dispenser 234 further includes an opening 238 that is formed in the exterior of the dispenser and extends into the container 236. Thus, the item is accessible a person when the item travels from the container 236 to the exterior of the dispenser 234 via the opening 238.

As shown in FIGS. 33–34, the item may be in the form of a food item, such as a candy 240. The dispenser 234 may be in the form of a gumball dispenser 242 which has a clear plastic container 236 attached to the mounting piece 70. The bottom of the mounting piece 70 has an opening (not shown) formed so that a candy 240 can travel through the opening to an exit 244. In order to control access to the candy 240, a rotating blocking member 246 is inserted into the mounting piece 70. The blocking member 246 is of a well known design that is used in gumball machines where rotation of the handle 248 will cause one candy 240 to be dispensed to the exit 244 where it can be removed while the other candies are blocked access to the exit 244.

Another embodiment of a dispenser and zipper system 232 where access to the candies within the container is controlled is shown in FIG. 34. There a dispenser 250 sold under the trademark PEZ is attached to the exterior surface 100 of the mounting piece 70. The dispenser 250 has a container 236 with a rectangular cross-section and an open top. The candies 240 are loaded into the container 236. Access to the candies 240 is accomplished by pivoting the blocking member 246 as shown in FIG. 34 and removing the top candy 240. Access to the other candies 240 is prevented by pivoting the blocking member 246 so that it covers and blocks the open top of the container 236. The pivoting blocking member 246 may be in the shape of a head of an animal figurine and may be biased to the blocking position by a spring (not shown).

Another embodiment of a dispenser and zipper system 232 is shown in FIG. 35. The dispenser 234 is in the form of a bottle where the container 236 is in direct fluid contact with an opening 238. A cap or a plug (not shown) may be placed over or into, respectively, the opening 238 in a well known manner to prevent access to the item which may be a liquid such as a soap solution or a perfume. Removal of the cap or plug allows the liquid to be removed by tilting the dispenser 234. In the case of a soap solution, a ring 252 is inserted through the opening 238 and into the soap solution within the container 236 and then removed from the dispenser 234. Blowing through the ring 252 will cause a bubble 254 to be formed.

Figure 36:
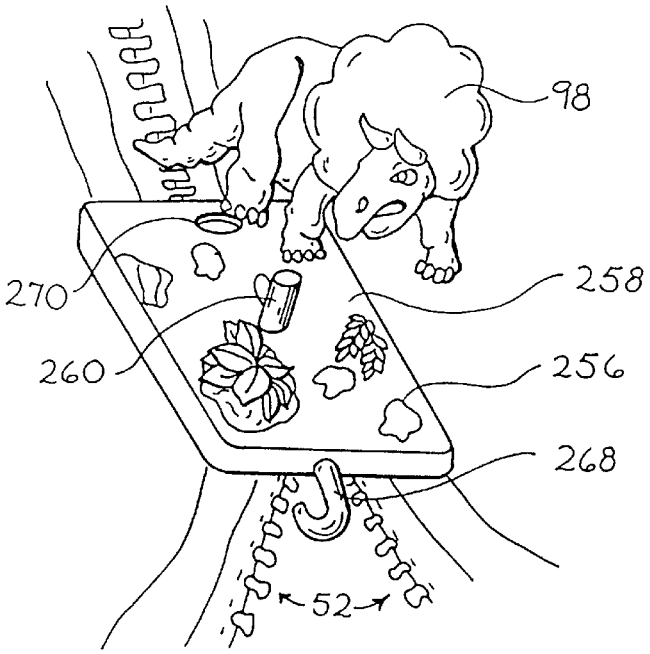
FIG. 36 schematically shows an embodiment of a figurine and zipper system with a removable figurine.
Figure 37:
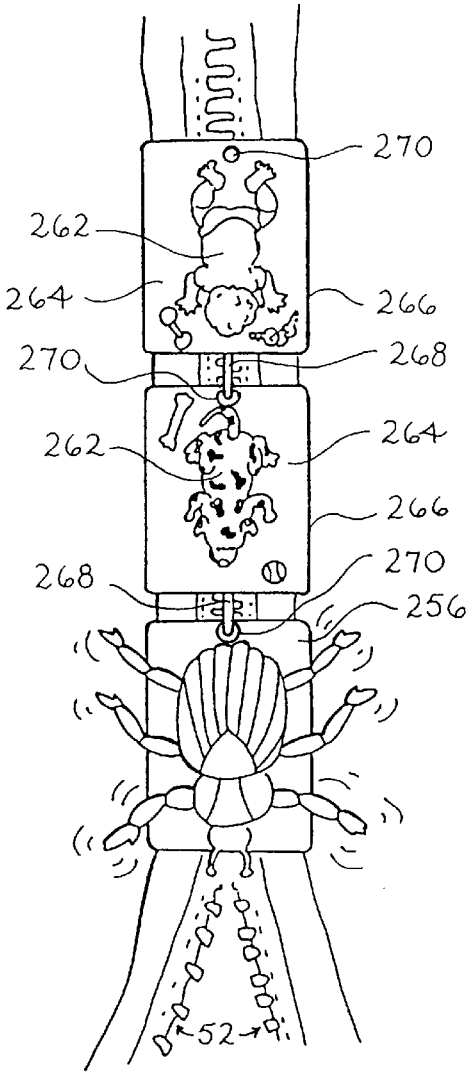
FIG. 37 schematically shows an embodiment of a figurine and zipper system with a plurality of removable figurines.

A figurine and zipper system is shown in FIGS. 36–37. A rectangular mounting piece 256 is attached to dee sliding piece 62 of the zipper 52 in any of the ways described with respect to FIGS. 2–7. The top exterior surface 258 of the mounting piece 256 has a structure so that a figurine 98 which is in the shape of a dinosaur, for example, is removably attached thereto. For example, the mounting piece 256 may have a circular opening (not shown) formed therein and the figurine 98 may have a male attachment element, such as a cylindrical peg (not shown), that is inserted into and fits snugly into the opening. Another variation shown in FIG. 36 is to have the opening (not shown) formed in the figurine 98 and the cylindrical peg 260 formed on the exterior surface 258 of the mounting piece 256. In either variation, the figurine 98 is removably attached to the mounting piece 256 by inserting the peg 260 into the opening. The figurine 98 is detached from the mounting piece 256 by removing the peg 260 from the opening.

One or more additional figurines 262 can be attached to the figurine 98 attached to the sliding piece 62 of the zipper 52. Each additional figurine 262 is attached to a top exterior surface 264 of a rectangular mounting piece 266 by the peg and opening structure used for figurine 98 and mounting piece 256. One end of each mounting piece 256 and 266 has a hook 268 attached thereto and the opposite end of the mounting piece 256 and 266 has a circular hole 270. Figurine 262 is attached to the figurine 98 by inserting the hook 268 into a bottom circular hole 270 formed in the mounting piece 254. The figurines 262 are attached to each other in a similar manner. Note that the mounting pieces 266 are not directly attached to the sliding piece 62 and so they may or may not have a structure to be attached to the sliding piece 62 as described previously with respect to FIGS. 2–7.

The foregoing description is provided to illustrate the invention, and is not to be construed as a limitation. Numerous additions, substitutions and other changes can be made to the invention without departing from its scope as set forth in the appended claims.

We claim:

1. A figurine and zipper system comprising:

a zipper attached to a piece of material, said zipper translationally moves along a first direction;

a mounting piece attached to said zipper, wherein said mounting piece translationally moves with said zipper along said first direction;

said mounting piece comprises a coupling mechanism that generates a first type of motion in response to but separate to said translational movement of said zipper along said first direction;

a figurine attached to said coupling mechanism so that said generated first type of motion causes a portion of said figurine to move.

2. The figurine and zipper system of claim 1, wherein said coupling mechanism comprises a driving wheel that engages either said zipper or said piece of material and rotates in response to said translational movement of said zipper along said first direction.

3. The figurine and zipper system of claim 2, wherein said driving wheel rotates about an axis that is substantially perpendicular to said first direction.

4. The figurine and zipper system of claim 2, further comprising:

a rod attaching said driving wheel to said portion of said figurine, wherein rotation of said driving wheel causes said rod to move which causes said portion of said figurine to move.

5. The figurine and zipper system of claim 4, wherein movement of said rod causes said portion of said figurine to pivot.

6. The figurine and zipper system of claim 5, wherein said figurine pivots about an axis that is parallel to an axis of rotation of said driving wheel.

7. The figurine and zipper system of claim 2, further comprising:

a cam wheel that engages said driving wheel and is attached to said portion of said figurine so that rotation of said driving wheel causes said cam wheel to rotate which causes said portion of said figurine to move.

8. The figurine and zipper system of claim 7, further comprising a rod attaching said cam wheel to said portion of said figurine, wherein rotation of said cam wheel causes said rod to move which causes said portion of said figurine to move.

9. The figurine and zipper system of claim 8, wherein movement of said rod causes said portion of said figurine to pivot.

10. The figurine and zipper system of claim 9, wherein said figurine pivots about an axis that is parallel to an axis of rotation of said driving wheel.

11. The figurine and zipper system of claim 7, wherein said driving wheel rotates about an axis that is parallel to an axis of rotation of said cam wheel.

12. The figurine and zipper system of claim 7, wherein said driving wheel rotates about an axis that is perpendicular to an axis of rotation of said cam wheel.

13. The figurine and zipper system of claim 7, wherein said figurine comprises an animal figurine and said portion of said figurine that is caused to move comprises a head of said animal figurine.

14. The figurine and zipper system of claim 1, wherein said figurine comprises an animal figurine and said portion of said figurine that is caused to move comprises a tail of said animal figurine.

15. The figurine and zipper system of claim 1, wherein said figurine comprises an animal figurine and said portion of said figurine that is caused to move comprises a head of said animal figurine.

16. The figurine and zipper system of claim 1, wherein said figurine comprises an animal figurine and said portion of said figurine that is caused to move comprises a tail of said animal figurine.

17. The figurine and zipper system of claim 1, wherein said figurine comprises an animal figurine and said portion of said figurine that is caused to move comprises a jaw attached to a head of said animal figurine.

18. The figurine and zipper system of claim 17, wherein said figurine comprises an animal figurine and said portion of said figurine that is caused to move comprises a tail of said animal figurine.

19. The figurine and zipper system of claim 17, wherein said figurine comprises an aquatic animal figurine and said portion of said figurine that is caused to move comprises a fin of said aquatic animal figurine.

20. The figurine and zipper system of claim 1, wherein said figurine comprises an aquatic animal figurine and said portion of said figurine that is caused to move comprises a fin of said aquatic animal figurine.

21. The figurine and zipper system of claim 1, wherein said figurine comprises an animal figurine and said portion of said figurine that is caused to move comprises a leg of said animal figurine.

22. The figurine and zipper system of claim 21, wherein said figurine comprises an animal figurine and said portion of said figurine that is caused to move comprises an arm of said animal figurine.

23. The figurine and zipper system of claim 1, wherein said figurine comprises an animal figurine and said portion of said figurine that is caused to move comprises an arm of said animal figurine.

24. The figurine and zipper system of claim 1, wherein said figurine comprises a head of an animal and said portion of said figurine that is caused to move comprises an eye of said head.

25. The figurine and zipper system of claim 24, wherein said portion of said figurine that is caused to move comprises a jaw of said head.

26. The figurine and zipper system of claim 1, wherein said figurine comprises a motor vehicle and said portion of said figurine that moves comprises a hood of said motor vehicle.

27. A figurine and zipper system comprising:

a zipper attached to a piece of material, said zipper translationally moves along a first direction;

a mounting piece attached to said zipper, wherein said mounting piece comprises a movable figurine and said mounting piece comprises a coupling mechanism that causes a portion of said figurine to move in response to said translational movement of said zipper along said first direction.

28. The figurine and zipper system of claim 27, wherein said coupling mechanism comprises a driving wheel that engages either said zipper or said piece of material and rotates in response to said translational movement of said zipper along said first direction.

29. The figurine and zipper system of claim 28, wherein said driving wheel rotates about an axis that is substantially perpendicular to said first direction.

30. The figurine and zipper system of claim 27, wherein said figurine comprises an animal figurine and said portion of said figurine that is caused to move comprises a head of said animal figurine.

31. The figurine and zipper system of claim 27, wherein said figurine comprises an animal figurine and said portion of said figurine that is caused to move comprises a tail of said animal figurine.

32. The figurine and zipper system of claim 27, wherein said figurine comprises an animal figurine and said portion of said figurine that is caused to move comprises a head of said animal figurine.

33. The figurine and zipper system of claim 27, wherein said figurine comprises an animal figurine and said portion of said figurine that is caused to move comprises a jaw attached to a head of said animal figurine.

34. The figurine and zipper system of claim 27, wherein said figurine comprises an aquatic animal figurine and said portion of said figurine that is caused to move comprises a fin of said aquatic animal figurine.

35. The figurine and zipper system of claim 27, wherein said figurine comprises an animal figurine and said portion of said figurine that is caused to move comprises a leg of said animal figurine.

36. The figurine and zipper system of claim 27, wherein said figurine comprises an animal figurine and said portion of said figurine that is caused to move comprises an arm of said animal figurine.

37. The figurine and zipper system of claim 27, wherein said figurine comprises a head of an animal figurine and said portion of said figurine that is caused to move comprises an eye of said head.

38. The figurine and zipper system of claim 27, wherein said figurine comprises a head of an animal figurine and said portion of said figurine that is caused to move comprises a jaw of said head.

39. The figurine and zipper system of claim 27, wherein said figurine comprises a motor vehicle and said portion of said figurine that moves comprises a hood of said motor vehicle.

40. The figurine and zipper system of claim 27, wherein said coupling mechanism causes the portion of the figurine to pivot.

41. The figurine and zipper system of claim 27, wherein said coupling mechanism causes the entire figurine to rotate.

42. The figurine and zipper system of claim 41, wherein said coupling mechanism also causes the entire figurine to translationally move in a direction perpendicular to said first direction.

43. The figurine and zipper system of claim 41, wherein said coupling mechanism also causes a portion of said figurine to pivot.

44. The figurine and zipper system of claim 41, wherein said figurine rotates about an axis that intersects said figurine.

45. The figurine and zipper system of claim 44, wherein said coupling mechanism causes said entire figurine to also rotate about an axis that does not intersect said figurine.

46. The figurine and zipper system of claim 41, wherein said figurine rotates about an axis that does not intersect said figurine.

47. The figurine and zipper system of claim 27, wherein said coupling mechanism causes said portion of said figurine to translationally move in a direction perpendicular to said first direction.

48. A method of moving a figurine, said method comprising the steps of:

attaching a figurine to a zipper that is attached to a piece of material; and translationally moving said zipper along a first direction which causes said figurine to move in a manner separate from said translational movement of said zipper.

49. The method of claim 48, wherein said movement of said figurine comprises pivoting.

50. The method of claim 48, wherein said figurine comprises an animal figurine.

51. The method of claim 50, wherein said portion of said figurine that is caused to move comprises a head of said animal figurine.

52. The method of claim 50, wherein said portion of said figurine that is caused to move comprises a tail of said animal figurine.

53. The method of claim 50, wherein said portion of said figurine that is caused to move comprises a jaw attached to a head of said animal figurine.

54. The method of claim 50, wherein said portion of said figurine that is caused to move comprises a fin of said animal figurine.

55. The method of claim 50, wherein said portion of said figurine that is caused to move comprises a leg of said animal figurine.

56. The method of claim 50, wherein said portion of said figurine that is caused to move comprises an arm of said animal figurine.

57. The method of claim 48, wherein said figurine is a head of an animal figurine and said portion of said figurine that is caused to move comprises an eye of said head.

58. The method of claim 57, wherein said portion of said of said figurine that is caused to move comprises a jaw of said head.

59. The method of claim 48, wherein said figurine comprises a motor vehicle and said portion of said figurine that moves comprises a hood of said motor vehicle.

60. A method of moving a figurine, said method comprising the steps of:

attaching a figurine to a zipper that is attached to a piece of material;

translationally moving said zipper along a first direction; and converting said translational movement of said zipper into a separate type of movement which causes said figurine to move.

61. The method of claim 60, wherein said separate type of movement comprises a pivoting movement.

62. The method of claim 61, wherein said separate type of movement further comprises a rotational movement.

63. The method of claim 60, wherein said separate type of movement comprises a rotational movement.

64. A sound generating zipper system comprising:

a zipper attached to a piece of material, said zipper comprising a sliding piece with an interior that receives said piece of material as said sliding piece translationally moves along a first direction; and a sound element attached to said sliding piece, wherein said sound element moves relative to said sliding piece and generates an audible sound in response to said translational movement of said sliding piece along said first direction that is independent of said piece of material received by said interior of said sliding piece.

65. The sound generating zipper system of claim 64, wherein said sound element contacts said zipper during said translational movement, said contact generates said audible sound.

66. The sound generating zipper system of claim 64, wherein said sound element comprises a ball.

67. A sound generating zipper system comprising:

a zipper attached to a piece of material, said zipper moves along a first direction;

a sound element attached to said zipper, wherein said sound element generates an audible sound in response to said translational movement of said zipper along said first direction; and said sound element comprises a rotating gear that contacts said zipper during said translational movement and generates said audible sound.

68. A sound generating zipper system comprising:

a zipper attached to a piece of material, said zipper moves along a first direction;

a sound element attached to said zipper and comprising a ball, wherein said sound element generates an audible sound in response to said translational movement of said zipper along said first direction; and said sound element comprises a driving wheel that engages either said zipper or said piece of material and rotates in response to said translational movement of said zipper along said first direction, wherein said ball contacts said driving wheel and generates said audible sound.

69. A method of generating an audible sound, said method comprising the steps of:

translationally moving a sliding piece of a zipper along a first direction so as to have a material pass through said sliding piece; and generating from said sliding piece an audible sound in response to said translational movement of said zipper along said first direction which is independent of any sound generated by said material passing through said sliding piece.

70. The method of claim 69, comprising the step of:

contacting said zipper during said translational movement so as to cause said audible sound to be generated.

71. A method of generating an audible sound, said method comprising the steps of:

translationally moving a zipper along a first direction:

generating an audible sound in response to said translational movement of said zipper along said first direction which is independent of any sound generated by the zipper itself;

contacting said zipper during said translational movement so that said audible sound is generated, wherein said contacting step comprises having a rotating gear contact said zipper during said translational movement.

72. A method of generating an audible sound, said method comprising the steps of:

translationally moving a zipper along a first direction;

generating an audible sound in response to said translational movement of said zipper along said first direction which is independent of any sound generated by the zipper itself;

contacting said zipper during said translational movement so that said audible sound is generated, wherein said contacting step comprises the steps of:

engaging a driving wheel with either said zipper or said piece of material so said driving wheel rotates in response to said translational movement of said zipper along said first direction; and contacting said rotating driving wheel with a ball so that said ball generates said audible sound.

73. A zipper attachment system comprising:

a fastener comprising:

a first row of teeth, a second row of teeth that is adjacent to said first row of teeth; and a sliding piece that receives said first and second rows of teeth and interlocks said first and second rows of teeth;

a mounting piece attached to said fastener, wherein said mounting comprises a driving wheel; and a strap attached at a first end thereof to said mounting piece, wherein said strap is placed over said sliding piece and a second end of said strap is attached to said mounting piece so that said sliding piece is held in place between said strap and said mounting piece.

74. The zipper attachment system of claim 73, wherein said sliding piece comprises a handle with an opening and said second end of said strap is inserted through said opening.

75. The zipper attachment system of claim 73, wherein said second end of said strap is inserted through an entry hole formed in said mounting piece.

76. The zipper attachment system of claim 75, comprising a peg attached to said mounting piece and wherein said sliding piece comprises a handle with an opening, wherein the peg is inserted through said opening.

77. A zipper attachment system comprising:

a fastener comprising:

a first row of teeth;

a second row of teeth that is adjacent to said first row of teeth; and a sliding piece that receives said first and second rows of teeth and interlocks said first and second rows of teeth;

a mounting piece attached to a first end of a strap, said mounting piece attached to said sliding piece by placing said strap over said sliding piece and a second end of said strap is attached to said mounting piece so that said sliding piece is held in place between said strap and said mounting piece so that said mounting piece is unable to move relative to said sliding piece.

78. The zipper attachment system of claim 77, wherein said sliding piece comprises a handle with an opening and said second end of said strap is inserted through said opening.

79. The zipper attachment system of claim 77, wherein said second end of said strap is inserted through an entry hole formed in said mounting piece.

80. A zipper attachment system comprising:

a fastener comprising:

a first row of teeth;

a second row of teeth that is adjacent to said first row of teeth; and a sliding piece that receives said first and second rows of teeth and interlocks said first and second rows of teeth;

a mounting piece attached to a first end of a strap, said mounting piece attached to said sliding piece by placing said strap over said sliding piece and a second end of said strap is attached to said mounting piece so that said sliding piece is held in place between said strap and said mounting piece and wherein said second end of said strap is inserted through an entry hole formed in said mounting piece; and a peg attached to said mounting piece, wherein said sliding piece comprises a handle with an opening, wherein the peg is inserted through said opening.

81. A zipper attachment system comprising:

a fastener comprising:

a first row of teeth;

a second row of teeth that is adjacent to said first row of teeth; and a sliding piece that receives said first and second rows of teeth and interlocks said first and second rows of teeth;

a mounting piece attached to a first end of a strap, said mounting piece attached to said sliding piece be placing said strap over said sliding piece and a second end of said strap is attached to said mounting piece so that said sliding piece is held in place between said strap and said mounting piece; and said mounting piece comprises a slot into which said sliding piece is inserted.

82. A zipper attachment system comprising:

a first row of teeth;

a second row of teeth that is adjacent to said first row of teeth; and a sliding piece defining a first opening into which said first row of teeth is inserted and a second opening into which said second row of teeth is inserted, wherein said sliding piece receives said first and second rows of teeth and interlocks said first and second rows of teeth;

a funnel attached to said sliding piece, wherein said funnel defines an opening that is not aligned with said second opening of said sliding piece and into which said first row of teeth is inserted.

83. The zipper attachment system of claim 82, wherein said funnel is C-shaped having a top side and a bottom side.

84. The zipper attachment system of claim 83, comprising a mounting piece attached to said top side of said funnel.

85. The zipper attachment system of claim 83, comprising a spring attached to said bottom side of said funnel and engaging a bracket at one end of said first row of teeth.

86. The zipper attachment system of claim 82, comprising a spring attached to said funnel and engaging a bracket at one end of said first row of teeth.

87. A zipper attachment system comprising:

a first row of teeth;

a second row of teeth that is adjacent to said first row of teeth;

a sliding piece that receives said first and second rows of teeth and interlocks said first and second rows of teeth;

a funnel attached to said sliding piece, wherein said funnel defines an opening into which said first row of teeth is inserted;

a mounting piece attached to a top side of said funnel; and wherein said sliding piece comprises a handle positioned between said mounting piece and said first and second rows of teeth.

88. The zipper attachment system of claim 87, comprising a strap attached to said mounting piece and engaging said handle.

89. A zipper attachment system comprising:

a first row of teeth;

a second row of teeth that is adjacent to said first row of teeth;

a sliding piece that receives said first and second rows of teeth and interlocks said first and second rows of teeth, said sliding piece comprising a first opening that is in fluid contact with a second opening end of said sliding piece;

a spring attached to said sliding piece that has a free end that is positioned exteriorly of said sliding piece; and a funnel attached to said sliding piece, wherein said funnel defines an opening that is not aligned with said second opening of said sliding piece and into which said first row of teeth is inserted.

90. The zipper attachment system of claim 89, wherein said funnel is C-shaped having a top side and a bottom side.

91. The zipper attachment system of claim 90, comprising a mounting piece attached to said top side of said funnel.

92. The zipper attachment system of claim 91, wherein said sliding piece comprises a handle positioned between said mounting piece and said first and second rows of teeth.

93. The zipper attachment system of claim 92, comprising a strap attached to said mounting piece and engaging said handle.

* * * * *

UNITED STATES PATENT AND TRADEMARK OFFICE

CERTIFICATE OF CORRECTION

PATENT NO. : 6,026,546
DATED : February 22, 2000
INVENTOR(S) : Bruce D. Lund et al.

It is certified that error appears in the above-identified patent and that said Letters Patent is hereby corrected as shown below:

Claim 13,
Line 1, delete "claim 7," and substitute -- claim 1, -- in its place.

Claim 23,
Line 1, delete "claim 1," and substitute -- claim 21, -- in its place.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*